US008061825B2

(12) United States Patent
Umeda

(10) Patent No.: US 8,061,825 B2
(45) Date of Patent: Nov. 22, 2011

(54) LIQUID CARTRIDGE

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 911 days.

(21) Appl. No.: 12/054,902

(22) Filed: Mar. 25, 2008

(65) Prior Publication Data

US 2008/0239034 A1 Oct. 2, 2008

(30) Foreign Application Priority Data

Mar. 26, 2007 (JP) ..... 2007-078153

(51) Int. Cl.
*B41J 2/17* (2006.01)
*B41J 2/175* (2006.01)

(52) U.S. Cl. ..... 347/86; 347/84; 347/85

(58) Field of Classification Search ..... 347/86
See application file for complete search history.

(56) References Cited

U.S. PATENT DOCUMENTS 5,621,450 A * 4/1997 Kawai et al. ..... 347/108
6,966,641 B2 11/2005 Taniguchi et al.
7,261,398 B2 * 8/2007 Greer ..... 347/85
2008/0084462 A1 * 4/2008 Hattori ..... 347/86

FOREIGN PATENT DOCUMENTS

JP 2004-181952 A 7/2004

* cited by examiner

*Primary Examiner* — Matthew Luu
*Assistant Examiner* — Renee Wilson
(74) *Attorney, Agent, or Firm* — Baker Botts L.L.P.

(57) ABSTRACT

A liquid cartridge mountable on a liquid droplet ejection device, includes a liquid chamber configured to store a liquid therein, and a pump unit configured to generate a pressure for the liquid stored in the liquid chamber to be supplied to the liquid droplet ejection device. The pump unit includes a cylinder; a piston slidably mounted in the cylinder and configured to define a pressure chamber with the cylinder; a force transfer member coupled to the piston and including an engagement portion and a support portion; and a support member configured to contact the support portion to support the force transfer member to be movable. The engagement portion is configured to engage a drive member of the liquid droplet ejection device and to receive a drive force from the drive member to displace the piston.

16 Claims, 19 Drawing Sheets

20
21
61
54A
62
54
60
54B
30
63
64
UP
DOWN
FRONT
REAR

LIQUID CARTRIDGE

CROSS-REFERENCE TO RELATED APPLICATION

This application claims priority from Japanese Patent Application No. 2007-078153, filed on Mar. 26, 2007, the entire disclosure of which is incorporated herein by reference. This application is also related to U.S. patent application Ser. No. 11/866,996, filed on Oct. 3, 2007, the entire disclosure of which is incorporated herein by reference.

TECHNICAL FIELD

Aspects of the present invention relate to a liquid cartridge which is configured to be removably mounted on a liquid droplet ejection device, more particularly, to an ink cartridge which is configured to be removably mounted on an ink jet printer.

BACKGROUND

A known ink jet printer as an example of a liquid droplet ejection device uses a so-called station supply system. The ink jet printer has a recording head, a sub-tank communicating with the recording head, and a carriage configured to reciprocate. The ink jet printer is configured to mount an ink cartridge. The ink jet printer is configured such that the carriage mounts thereon the recording head and the sub-tank, and the ink cartridge communicates with the sub-tank only when ink needs to be supplied from the ink cartridge to the sub-tank. In the other timing (when the ink needs not to be supplied from the ink cartridge to the sub-tank), the ink cartridge does not communicate with the sub-tank, and the ink cartridge and the sub-tank are separated from each other. Accordingly the ink is supplied from the ink cartridge to the sub-tank intermittently (e.g., see JP-A-2004-181952).

SUMMARY

In the development of such ink jet printer using the station supply system, the inventor of the present invention has studied and built a prototype of an ink jet printer which is described in a U.S. patent application Ser. No. 11/866,996. In this ink jet printer, an ink cartridge includes a pump unit therein for supplying ink to the sub-tank. A drive force is provided from the printer to actuate the pump unit to supply ink to the sub-tank.

The pump unit of this ink cartridge includes a cylinder; a piston slidably mounted in the cylinder; and a force transfer member (e.g., a piston rod) which receives a drive force from the printer to displace the piston.

Since this prototype is configured such that the force transfer member receives the drive force from the printer by engaging the drive member of the printer, the drive force applied to the force transfer member may cause the force transfer member to bend. Such a bend may possibly cause the force transfer member not to smoothly move, and therefore, it may be difficult to stably drive the force transfer member.

Exemplary embodiments of the present invention address the above disadvantages and other disadvantages not described above. However, the present invention is not required to overcome the disadvantages described above, and thus, an exemplary embodiment of the present invention may not overcome any of the problems described above.

Accordingly, it is an aspect of the present invention to provide a liquid cartridge mountable on a liquid droplet ejection device and which allows for smooth movement of a force transfer member of a pump unit for generating a pressure for liquid to be supplied from the liquid cartridge to the liquid droplet ejection device.

According to an exemplary embodiment of the present invention, there is provided a liquid cartridge mountable on a liquid droplet ejection device including an ejection head for ejecting liquid droplets and a sub-tank for temporarily storing a liquid to be supplied to the ejection head. The liquid cartridge includes: a liquid chamber configured to store a liquid therein, and a pump unit configured to generate a pressure for the liquid stored in the liquid chamber to be supplied to the sub-tank. The pump unit including: a cylinder; a piston mounted in the cylinder slidably in a sliding direction and the cylinder and the piston configured to define a pressure chamber communicating with the liquid chamber; a force transfer member coupled to the piston and including an engagement portion and a support portion which is positioned opposite the engagement portion, the engagement portion configured to engage a drive member of the liquid droplet ejection device and to receive a drive force from the drive member to displace the piston; and a support member configured to contact the support portion to support the force transfer member to be movable in the sliding direction.

According to another exemplary embodiment of the present invention, there is provided a liquid cartridge comprising: a liquid chamber configured to store a liquid, the liquid chamber including an liquid outlet; a cylinder; a piston mounted in the cylinder slidably in a sliding direction, and the cylinder and the piston configured to define a pressure chamber communicating with the liquid chamber; a force transfer member coupled to the piston and including an engagement portion and a support portion which is positioned opposite the engagement portion, the engagement portion configured to engage a drive member and to receive a drive force from the drive member to displace the piston; and a support member configured to contact the support portion to support the force transfer member to be movable in the sliding direction.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

Exemplary embodiments of the present invention will now be discussed with reference to the accompanying drawings.

Figure 1:
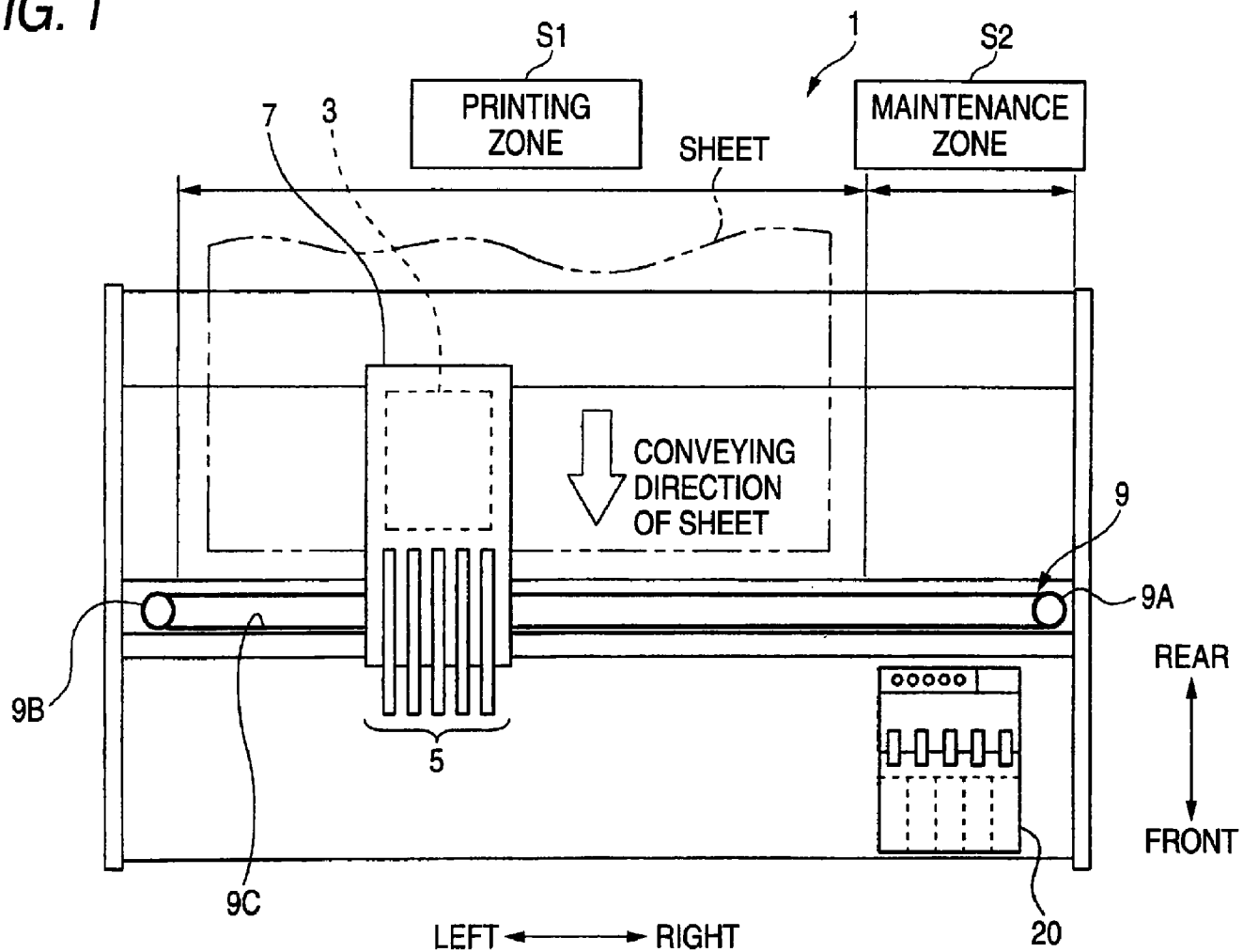
FIG. 1 is a schematic diagram of a part of an ink jet printer according to an exemplary embodiment of the present invention.

Referring to FIG. 1, an inkjet printer 1 as an example of a liquid droplet ejection device is configured to convey a recording medium such as a recording sheet while ejecting fine ink droplets to the recording sheet, thereby forming an image on the recording sheet. The recording sheet may include, for example, a sheet of paper, cloth, resin film, and an optical recording disk, but for convenience, hereinafter is referred to as a "sheet".

The ink jet printer 1 includes a carriage 7 that mounts a recording head 3 which ejects ink droplets onto the sheet and a sub-tank 5 which temporarily stores an ink, as an example of a liquid, to be supplied to the recording head 3. The carriage 7 reciprocates in a main-scanning direction (in the right and left direction in FIG. 1) by means of a carriage drive mechanism 9.

When a recording operation is performed, the recording head 3 ejects ink onto the sheet, which is being conveyed by a conveying mechanism (not shown), while reciprocating in a printing zone S1 in the main-scanning direction. On the other hand, when the recording operation is not performed, or when a maintenance operation is performed, e.g., when ink is supplied from an ink cartridge 10, which is described in detail later, to the sub-tank 5, the carriage 7 moves to a maintenance zone S2.

The recording head 3 includes a pressure applying unit which applies pressure to ink within the recording head 3 such that the recording head 3 ejects ink. The pressure applying unit utilizes a deformation of a piezoelectric element or formation of bubbles by a thermal resistor to apply pressure to ink. The number of the sub-tank 5 corresponds to the types of color of the ink to be ejected from the recording head 3. In this exemplary embodiment, five sub-tanks 5 are used, which correspond to five colors, i.e., cyan (C), magenta (M), yellow (Y), photo black (PBk), and black (Bk), respectively. Specifically, the photo black (PBk) includes a dye ink and the black (Bk) includes a pigment ink.

The carriage drive mechanism 9 includes a driver pulley 9A provided at one end of a path along which the carriage 7 reciprocates; a follower pulley 9B provided at the other end of the path; and an endless belt 9C looped between the pulleys 9A and 9B. The carriage 7 is fixed to the endless belt 9C. The driver pulley 9A is driven by a drive motor (not shown) such that the driver pulley 9A rotates in forward and reverse directions. When the driver pulley 9A rotates in the forward and reverse directions, the endless belt 9C rotates in forward and reverse directions, thereby allowing the carriage 7 to reciprocate in the main-scanning direction.

Furthermore, a main tank unit 20 is disposed at one end of the path along which the carriage 7 reciprocates. The main tank unit 20 accommodates ink cartridges 10 which stores inks to be supplied to the sub-tanks 5. In this exemplary embodiment, five ink cartridges 10 are used, which correspond to five colors, i.e., cyan (C), magenta (M), yellow (Y), photo black (PBk), and black (Bk), respectively.

Figure 2A:
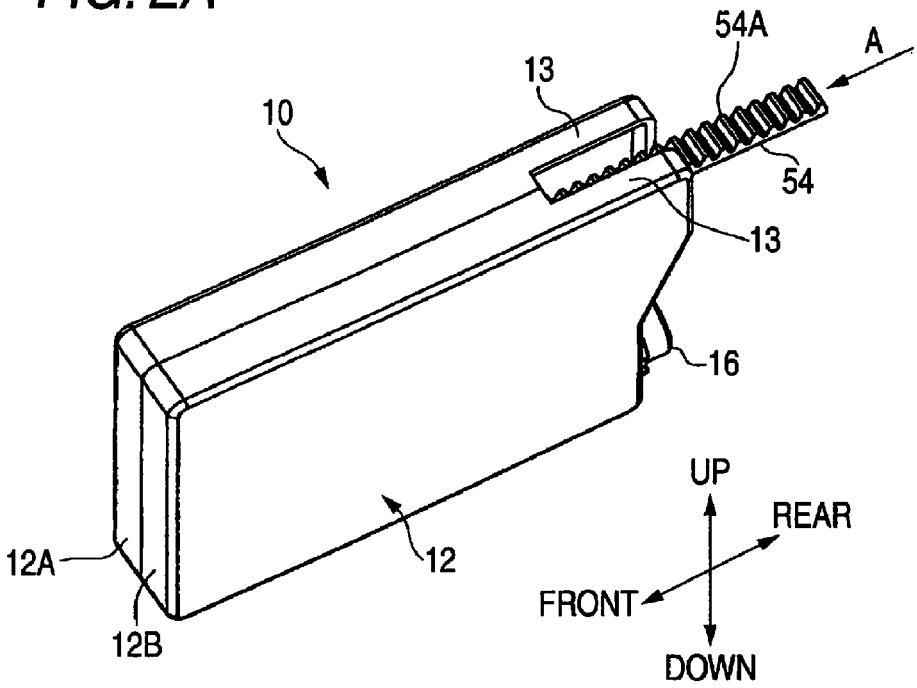
FIG. 2A is a perspective view of an ink cartridge according to an exemplary embodiment of the present invention, and FIG. 2B of a rear side view of the ink cartridge in FIG. 2A when viewed from a direction indicated by an arrow A in FIG. 2A.
Figure 2B:
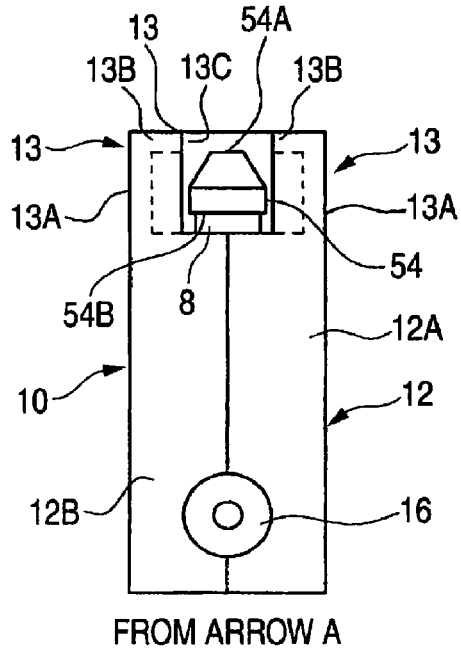
Figure 3:
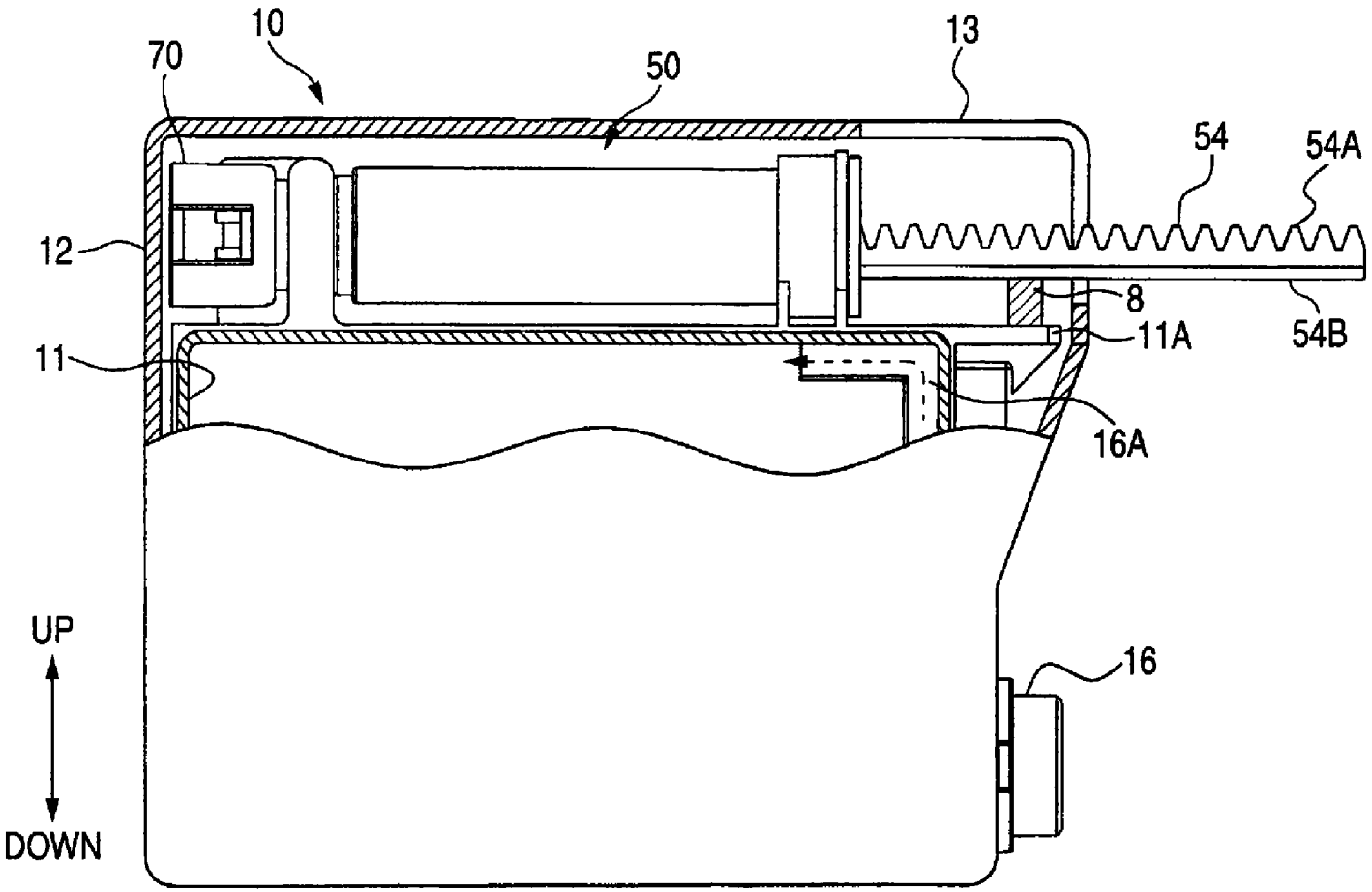
FIG. 3 is a partial-cross-sectional side view of the ink cartridge of FIG. 2A.

Referring to FIGS. 2A to 5, the ink cartridge 10 includes a main tank 11, as an example of a liquid chamber, which stores ink to be supplied to the sub-tank 5, a piston pump mechanism 50, as an example of a pump unit, which generates a pressure for the ink to be supplied from the main tank 11 to the sub-tank 5, and a cartridge casing 12. The piston pump mechanism 50 is located above the main tank 11, thereby allowing the piston pump mechanism 50 and the main tank 11 to be aligned in the vertical direction within the cartridge casing 12 as shown in FIG. 3. In addition, the cartridge casing 12 includes first and second casings 12A and 12B coupled to each other, as shown in FIG. 2A. The cartridge casing 12 has a front face and a rear face opposite the rear face, and the front face and the rear face are aligned in a lengthwise direction of the cartridge casing 12.

Figure 4:
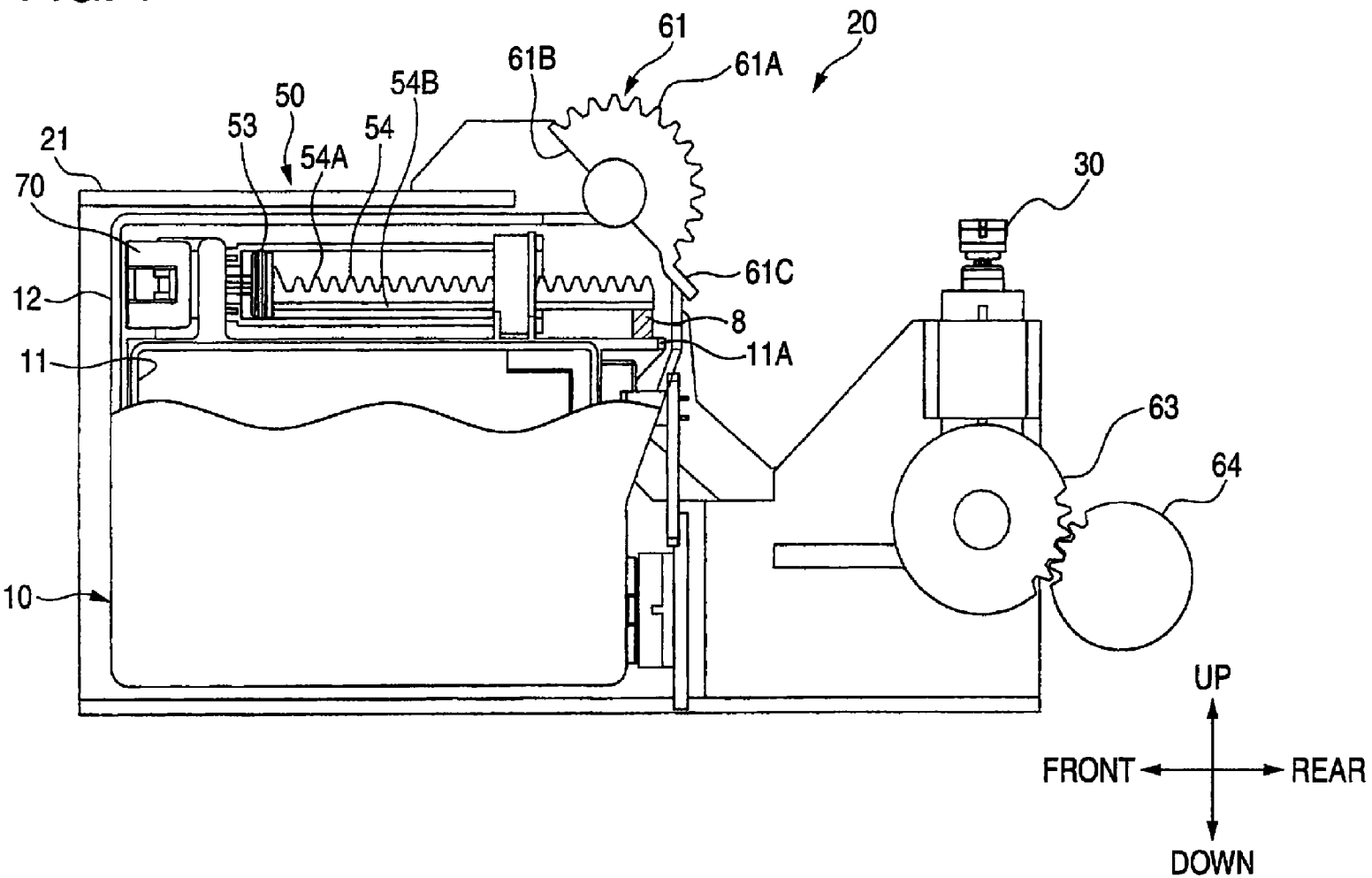
FIG. 4 is a partial-cross-sectional side view of the ink cartridge of FIG. 2A and a main tank unit according to an exemplary embodiment of the present invention.
Figure 5:
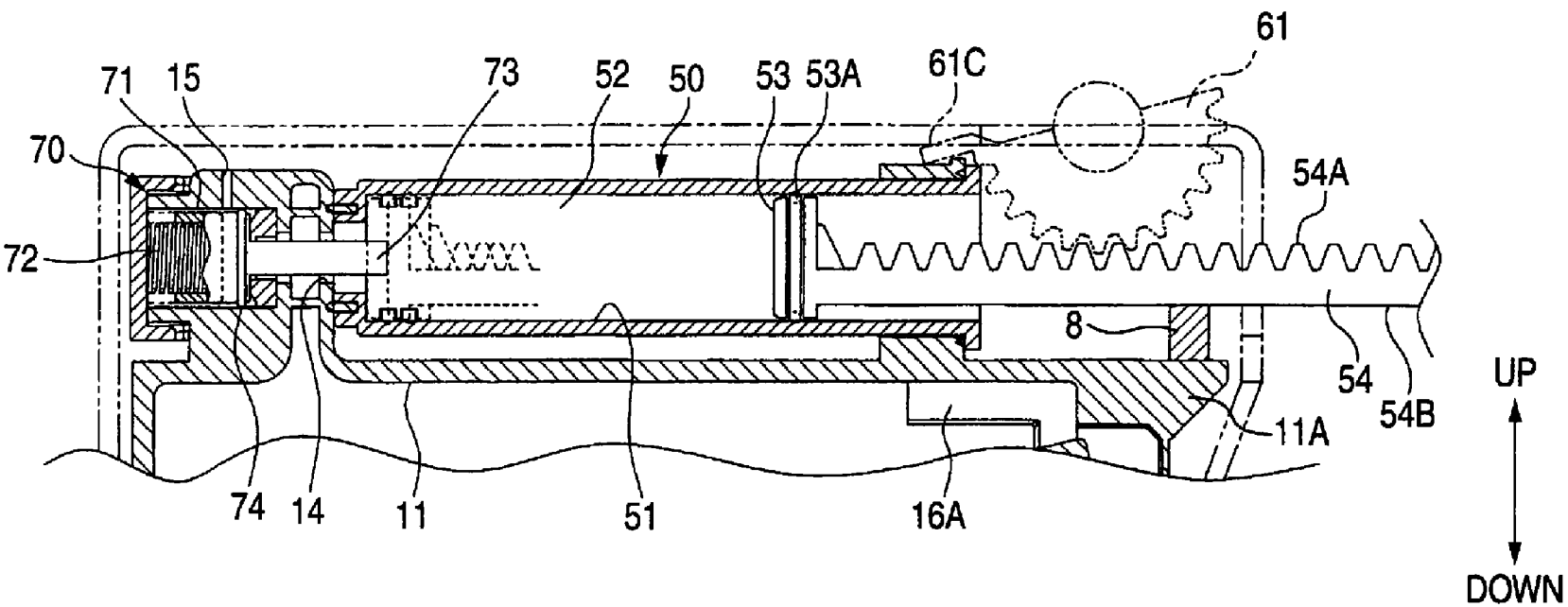
FIG. 5 is a cross-sectional side view of a piston pump mechanism according to an exemplary embodiment of the present invention.

Referring to FIGS. 4 and 5, the piston pump mechanism 50 includes a tubular cylinder 51; a piston 53 mounted in the cylinder 51 slidably in a sliding direction which is parallel to the horizontal direction and to the lengthwise direction; and a piston rod 54, as an example of a force transfer member, integrally coupled to the piston 53. The cylinder 51 and the piston 53 are configured to define a pressure chamber 52 communicating with the main tank 11. The piston rod 54 is configured to receive a drive force from a pump drive mechanism 60 (to be described later) such that the piston rod 54 moves in the sliding direction, and exerts a force to displace the piston 53 in the sliding direction. It is noted that the tubular cylinder may be a circular cylinder or a rectangular cylinder, or may have other shape.

The piston 53 includes a recessed groove formed in an outer circumferential thereof and an O-ring 53A fitted in the recessed groove to seal the space between the outer circumferential of the piston 53 and the inner circumferential of the cylinder 51. When the piston 53 slidably moves in the cylinder 51, the O-ring 53A is brought into contact with the inner circumferential surface of the cylinder 51, thereby keeping the pressure chamber 52 airtight.

Furthermore, the piston 53 and the piston rod 54 are integrally molded of a synthetic resin, and on the surface of the piston rod 54 opposite to the main tank 11, there is formed a rack gear 54A, serving as an engagement portion, configured to engage a pinion 61 of the pump drive mechanism 60 serving as a drive member.

Furthermore, referring to FIG. 2B, on both sides across the piston rod 54, there are provided rod covers 13 which cover and protect at least a portion of the piston rod 54 at which the rack gear 54A and the pinion 61 engage with each other. The piston rod 54 has a length in the lengthwise direction. The rod covers 13 are designed to cover the entire length of the piston rod 54 at least when the pressure chamber 52 has the minimum volume (i.e., when the piston 53 is located at the leftmost position in the cylinder 51 in FIGS. 4 and 5). Accordingly, when the piston 53 is located at the position where the pressure chamber 52 has the minimum volume, the piston rod 54 is entirely positioned between the front face and the rear face of the cartridge casing 12 in the lengthwise direction of the cartridge casing 12, which is parallel to the sliding direction.

Each of the rod covers 13 has a substantially L-shape in cross section in a plane perpendicular to the lengthwise direction of the cartridge casing 12. Rod covers 13 have right and left side cover portions 13A, respectively, which cover the right and left side surfaces of the piston rod 54, respectively, and rod covers 13 have rack cover portions 13B, respectively, which cover the right and left upper surfaces of the rack gear 54A, respectively. A gap 13C is formed between the rack cover portions 13B. The gap 13C is slightly greater than the piston rod 54 in a widthwise direction which is perpendicular to the lengthwise direction, and the pinion 61 (to be described later) can be inserted into the gap 13C. In addition, the pair of right and left rod covers 13 are molded integrally with the first and second casings 12A and 12B, respectively.

The main tank 11 includes an ink supply outlet 16 positioned at the rear face of the cartridge casing 12 and configured to be communicated with a second joint valve 30 (to be described later) for supplying ink to the sub-tank 5. Near the ink supply outlet 16, an open/close valve (not shown) is provided for opening and closing the ink supply outlet 16. A first check valve (not shown) is provided for permitting ink to flow only from the main tank 11 toward the sub-tank 5 via the ink supply outlet 16, and a second check valve (not shown) for permitting ink to flow only from the sub-tank 5 back to the main ink tank 11 via the ink supply outlet 16. The ink returned from the sub-tank 5 flows into the main tank 11 from the upper portion of the main tank 11 through a return path 16A. The ink supply outlet 16 is provided at a lower end portion of the main tank 11 on the side from which the piston rod 54 of the piston pump mechanism 50 is protruded.

Furthermore, the ink cartridge 10 includes a retaining unit 11A positioned above the main tank 11 and facing the piston rod 54. That is, the retaining unit 11A is provided between the main tank 11 and the piston rod 54. The retaining unit 11A includes a rib 8, serving as a support member, which supports the piston rod 54. That is, the piston rod 54 includes a support portion 54B positioned opposite the rack gear 54A, and the rib 8 supports the piston rod 54 by contacting the support portion 54B of the piston rod 54 from below at a position opposite to the portion at which the pinion 61 and the rack gear 54A engage with each other. Supporting the piston rod 54 in this manner will allow the piston rod 54 to be stably driven such that the piston rod 54 makes a smooth, linear movement.

Furthermore, referring to FIG. 5, a path 14 extending from the pressure chamber 52 to the main tank 11 can communicate with the atmosphere via an atmosphere communication hole 15. A path extending from the atmosphere communication hole 15 to the path 14 is provided with an atmosphere release valve 70. The atmosphere release valve 70 switches between a communicating state in which the main tank 11 communicates with the atmosphere via the atmosphere communication hole 15 and a non-communicating state in which the communication between the main tank 11 and the atmosphere via the atmosphere communication hole 15 is prevented.

The atmosphere release valve 70 includes a valve body portion 71 which has a cylindrical shape with a bottom and is movable in the sliding direction within a cylindrical chamber, a spring 72 which resiliently urges the valve body portion 71 toward the pressure chamber 52, and a push rod unit 73 coupled to the bottom of the valve body portion 71 and extending to the pressure chamber 52 through the path 14. The atmosphere communication hole 15 is opened at the inner surface of the cylindrical chamber, extends from the inner surface of the cylindrical chamber in a direction perpendicular to the sliding direction, and is opened to the atmosphere within the cartridge casing 12. The outer circumferential surface of the valve body portion 71 is provided with an O-ring 74. The O-ring 74 is slidably in contact with the inner surface of the cylindrical chamber and seals a space between the inner surface of the cylindrical chamber and the outer circumferential surface of the valve body portion 71.

When the piston 53 moves to the left in FIG. 5 to reduce the volume of the pressure chamber 52, the valve body portion 71 of the atmosphere release valve 70 is pushed by the piston 53 via the push rod unit 73. This causes the valve body portion 71 to slide to the left from the state shown in FIG. 5 against the urging force of the spring 72. Then, O-ring 74 moves to the left beyond the atmosphere communication hole 15. Therefore, the path 14 communicates with the atmosphere via the atmosphere communication hole 15. In other words, the main tank 11 communicates with the atmosphere via the atmosphere communication hole 15. Conversely, when the piston 53 moves to the right in FIG. 5 to increase the volume of the pressure chamber 52, the valve body portion 71 of the atmosphere release valve 70 slides to the right by the urging force of the spring 72 to be positioned in the state as shown in FIG. 5. As a result, the communication between the path 14 and the atmosphere via the atmosphere communication hole 15 is prevented because the O-ring 74 seals the space between the inner surface of the cylindrical chamber and the outer circumferential surface of the valve body portion 71 between the atmosphere communication hole 15 and the path 14. In other words, the communication between the main tank 11 and the atmosphere via the atmospheric communication hole 15 is prevented.

Figure 6:
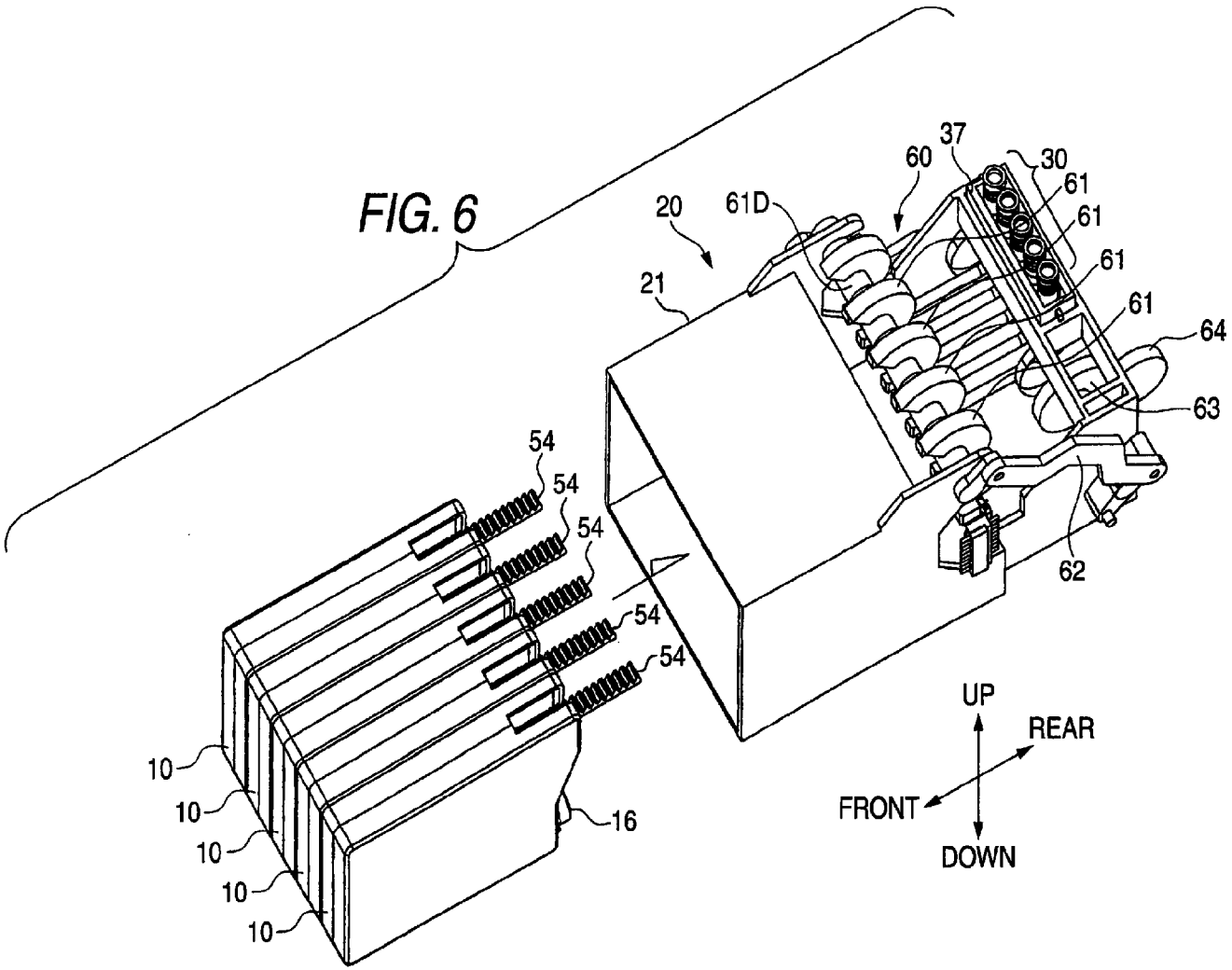
FIG. 6 is a perspective view of the main tank unit and the ink cartridges of FIG. 4 in which the ink cartridges are removed from the main tank unit.
Figure 7:
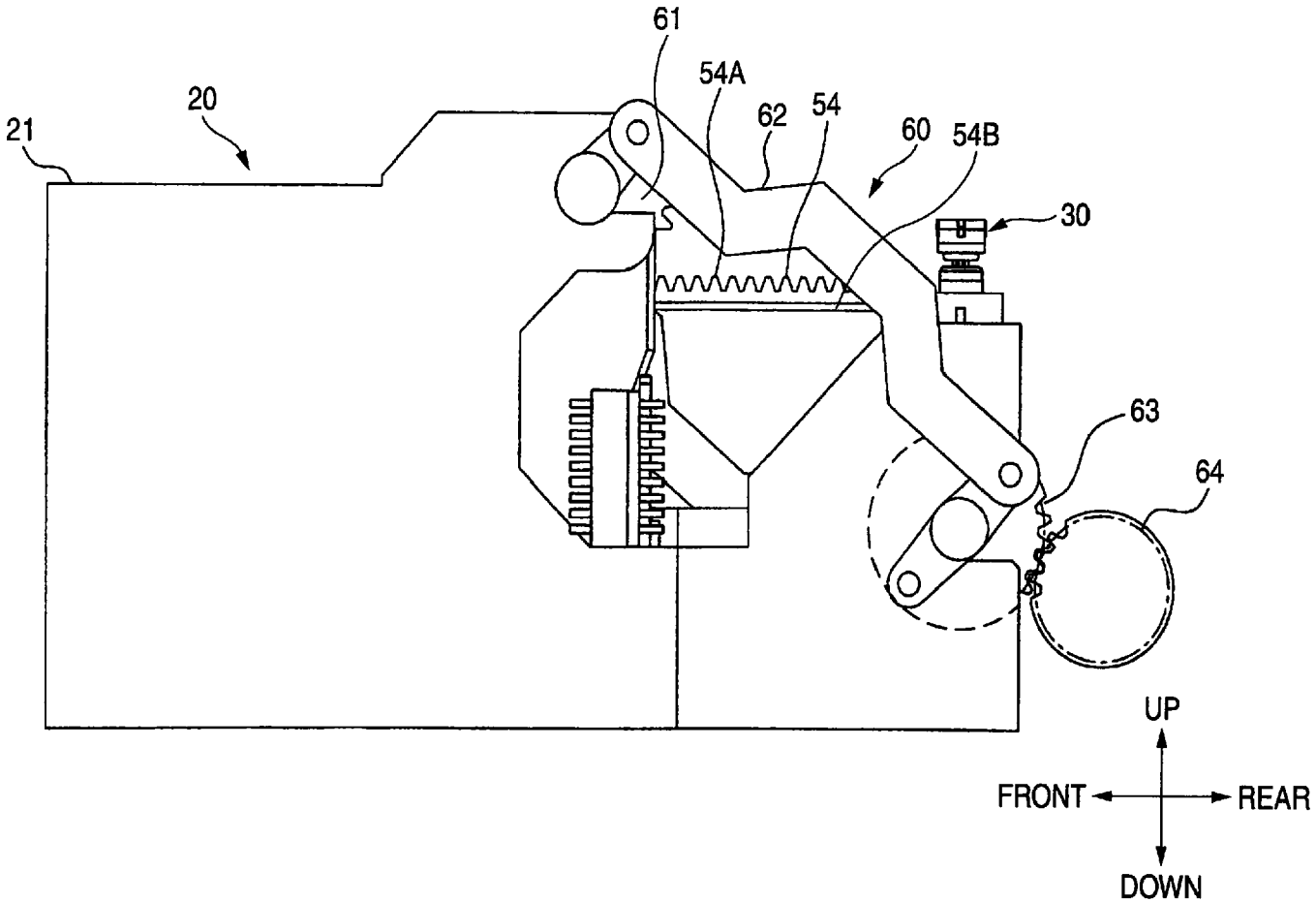
FIG. 7 is a side view of the ink cartridges and the main tank unit of FIG. 4 in which the ink cartridges are mounted in the main tank unit.
Figure 8:
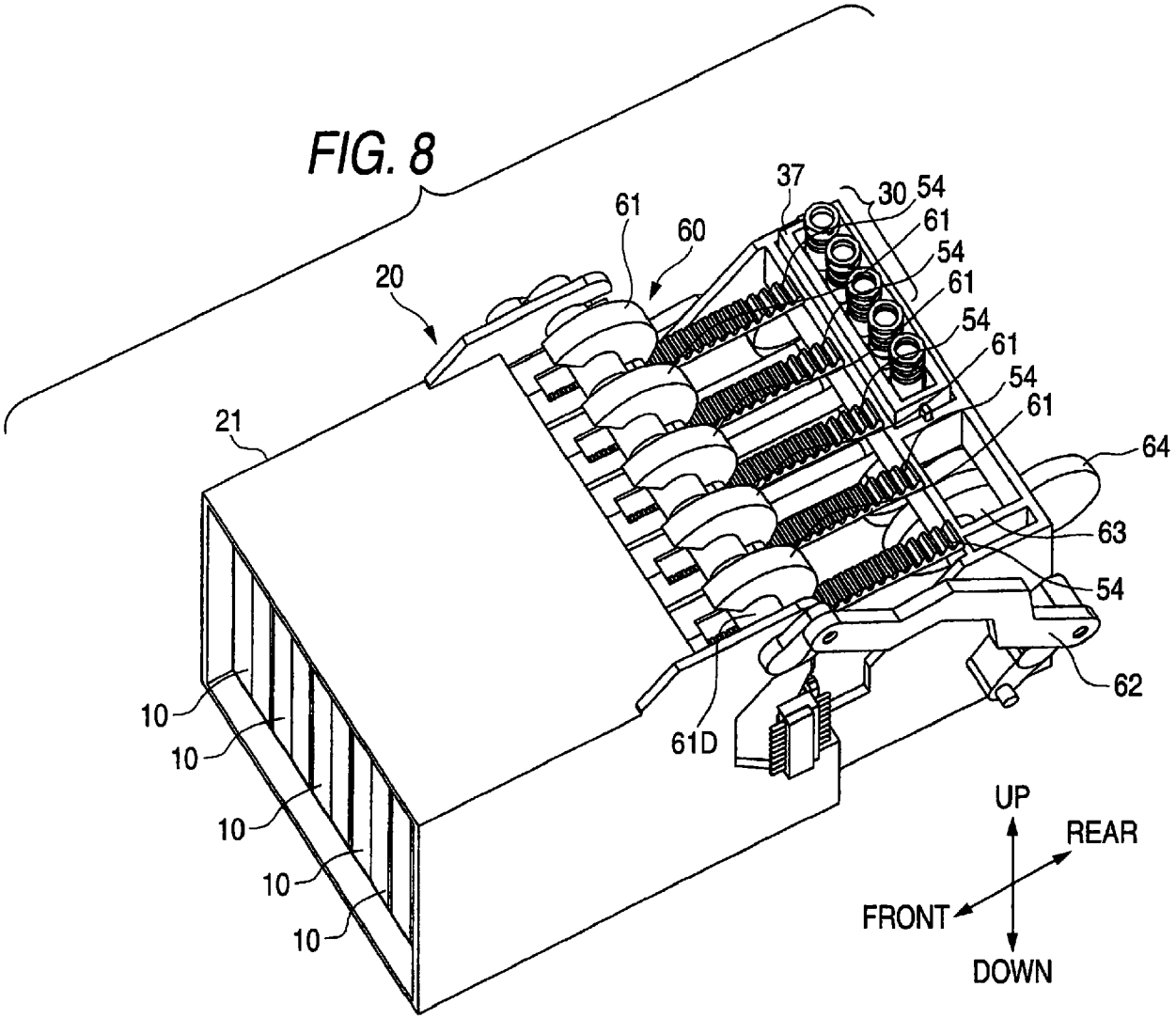
FIG. 8 is a perspective view of the ink cartridges and the main tank unit of FIG. 4 in which the ink cartridges are mounted in the main tank unit.
Figure 9:
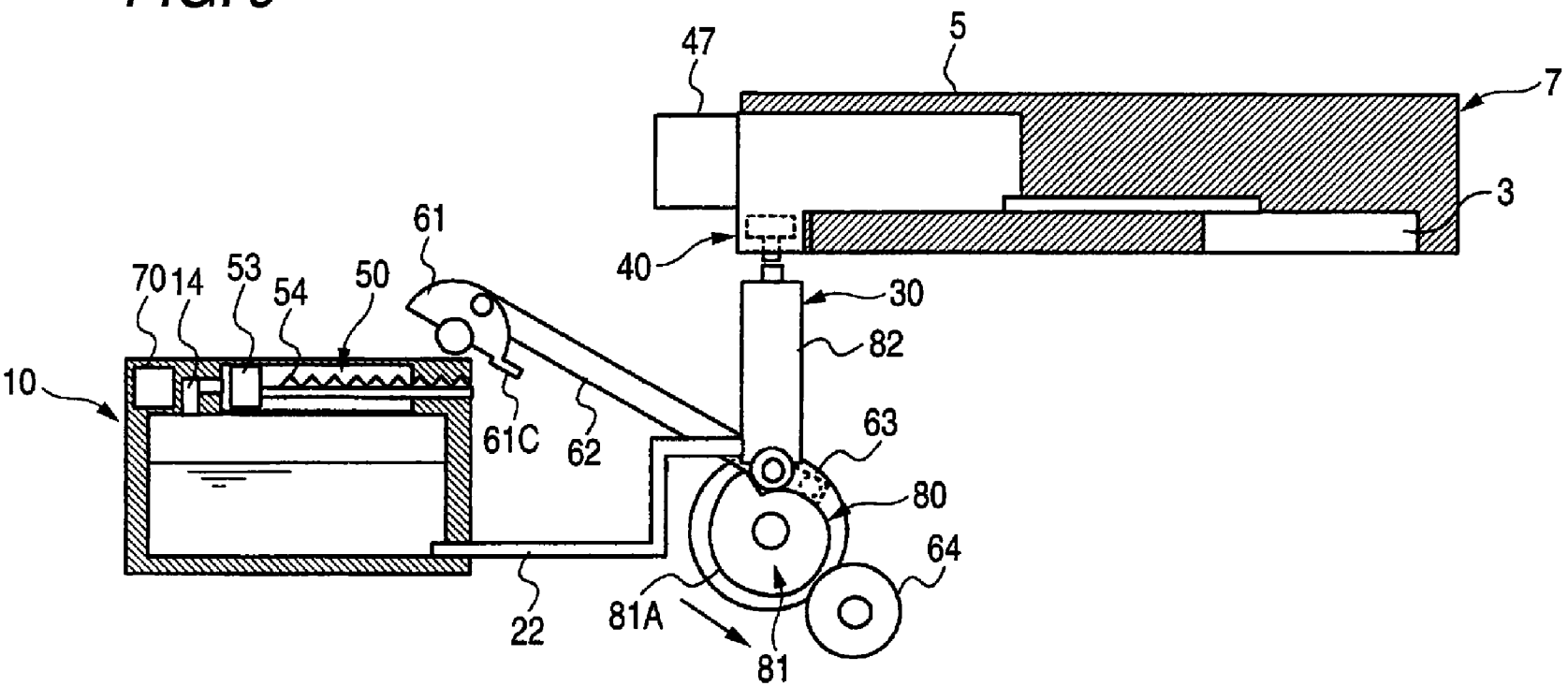
FIG. 9 is a schematic diagram of the ink cartridge and the main tank unit of FIG. 4 and a carriage according to an exemplary embodiment of the present invention.

Referring to FIGS. 6 to 8, the main tank unit 20 includes an cartridge accommodating casing 21, and the ink cartridges 10 are removably mounted to the cartridge accommodating casing 21 from one side of the cartridge accommodating casing 21. On another side of the cartridge accommodating casing 21 opposite the one side, the main tank unit 20 includes the pump drive mechanism 60 which drives the piston pump mechanism 50 included in each ink cartridge 10, and the second joint valves 30. Referring to FIG. 9, the main tank unit 20 further includes a joint valve connection mechanism 80. The joint valve connection mechanism 80 displaces the second joint valves 30 to selectively connect and disconnect the second joint valves 30 to/from first joint valves 40 provided at the carriage 7, respectively, to supply ink from the main tank units 20 to the sub-tanks 5. The number of the second joint valves 30 and the number of the first joint valves 40 are associated with the number of the sub-tanks 5, that is, five second joint valves 30 and five first joint valves 40 are provided in this exemplary embodiment. As will be described later, these five second joint valves 30 are mechanically synchronized with each other so as to be integrally displaced by the joint valve connection mechanism 80.

Referring to FIG. 7, the pump drive mechanism 60, which provides drive force to the piston rods 54 of five ink cartridges 10 to allow the pistons 53 to slide, includes five pinions 61, a pinion link 62, and the first and second transfer gears 63 and 64.

The second transfer gear 64 is configured to be rotated by the drive force applied from a sheet conveying motor (not shown). The drive force transferred to the second transfer gear 64 is transmitted to the pinions 61 via the first transfer gear 63 engaging the second transfer gear 64 and the pinion link 62 which is coupled to the pinions 61 and to the first transfer gear 63. Although not specifically illustrated, with a drive force switching solenoid (not shown), the drive force from the sheet conveying motor is selectively transmitted to a sheet conveying roller (not shown) and to the second transfer gear 64.

Referring to FIG. 4, the pinion 61 includes a teeth portion 61A which engages the rack gear 54A and a non-tooth portion 61B which does not engage the rack gear 54A. The non-tooth portion 61B includes a projected rod contact portion 61C configured to contact with an end of the piston rod 54 (the right end in FIG. 4) to displace the piston rod 54 and the piston 53 to a predetermined initial position. For initialization, the non-tooth portion 61B may face the rack gear 54A. This prevents the rack gear 54A and the pinion 61 from engaging with each other and causes the pinion 61 to rotate while the rod contact portion 61C contacts the end of the piston rod 54 so that the piston rod 54 is displaced to reduce the volume of the pressure chamber 52. At the end of the rotation of the pinion 61, the piston 53 pushes the push rod unit 73. Accordingly, the atmosphere communication hole 15 communicates with the main tank 11 so that an internal pressure of the main tank 11 becomes equal to the atmospheric pressure.

Referring to FIG. 6, since the five pinions 61 are coupled to one rotational shaft 61D to integrally rotate thereabout, the five pinions 61 are mechanically synchronized and rotated by the same amount of rotation or the same rotational angle.

Figure 10:
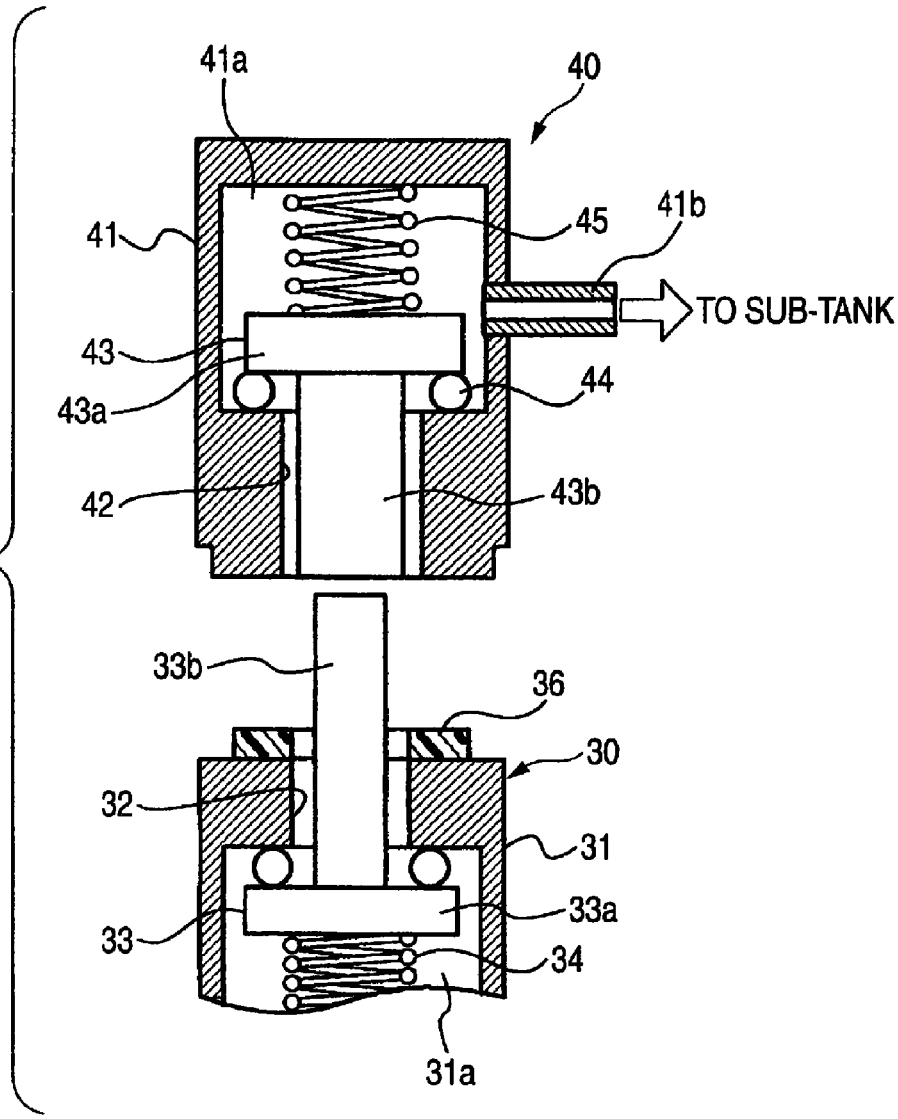
FIG. 10 is a cross-sectional view of first and second joint valves according to an exemplary embodiment of the present invention.

In order to fill or refill the sub-tank 5 with ink, the second joint valves 30 and the first joint valves 40 are respectively connected with each other so that the sub-tanks 5 and the main tanks 11 of the ink cartridges 10 respectively communicate with each other. Referring to FIGS. 9 and 10, the main tank unit 20 includes five ink supply tubes 22, serving as liquid supply tubes, and five joint portions (not shown), corresponding to five ink cartridges 10. Each joint portion is positioned at one end of a corresponding one of the ink supply tubes 22 and configured to be connected to the supply outlet 16 of a corresponding one of the ink cartridges 10. Each second joint valve 30 is positioned at the other end of a corresponding one of the ink supply tubes 22, and the inside of the second joint valve 30, that is, a valve chamber 31*a* communicates with the inside of the main tank 11 of the ink cartridge 10 via the ink supply tube 22.

Referring to FIG. 10, the second joint valve 30 includes a substantially cylindrical valve housing 31, and the valve housing 31 has the valve chamber 31*a* formed therein and an opening 32 which communicates with the valve chamber 31*a* and is formed through an upper portion of the valve housing 31 to face the first joint valve 40. The opening 32 is selectively opened and closed by a valve body 33 that is positioned so as to be movable in the valve chamber 31*a*. Here, the expression, "the opening 32 is opened" means that the valve chamber 31*a* communicates with the outside of the valve housing 31 via the opening 32, and the expression, "the opening 32 is closed" means that the communication between the valve chamber 31*a* and the outside of the valve housing 31 via the opening 32 is prevented.

A coil spring 34 is also positioned in the valve chamber 31*a* to apply an urging force to the valve body 33 such that the opening 32 is closed by the valve body 33. The valve body 33 includes a disk-shaped valve portion 33*a* contacting the coil spring 34, and a valve shaft portion 33*b* protruding from the valve portion 33*a* toward the first joint valve 40 through the opening 32. The valve shaft portion 33*b* is integral with the valve portion 33*a*. The valve shaft portion 33*b* of the valve body 33 is configured to push a valve shaft portion 43*b* of a valve body 43 of the first joint valve 40 to open an opening 42 of the first joint valve 40. A joint rubber 36 is positioned at the outer surface of the upper portion of the valve housing 31, and has an annular shape to surround the opening 32. When the first joint valve 40 and the second joint valve 30 are connected with each other, the joint rubber 36 is sandwiched by the valve housing 31 and a valve housing 41 of the first joint valve 40 such that the joint rubber 36 elastically deforms to seal the valve chamber 31*a* and a valve chamber 41*a* of the first joint valve 40 from the outside of the valve housing 31 and the valve housing 41 in a liquid-tight manner. The joint rubber 36 also alleviates the speed and the impact when the joint valves 30 and 40 are connected with each other.

The first joint valve 40 includes the substantially cylindrical valve housing 41, and the valve housing 41 has the valve chamber 41*a* formed therein and the opening 42 which communicates with the valve chamber 41*a* and is formed through a lower portion of the valve housing 41 to face the second valve 30. The first valve 40 includes a tubular path portion 41*b* through which the valve chamber 41*a* communicates with the sub-tank 5. The opening 42 is selectively opened and closed by the valve body 43 that is positioned so as to be movable inside the valve housing 41. Here, the expression, "the opening 42 is opened" means that the valve chamber 41*a* communicates with the outside of the valve housing 41 via the opening 42, and the expression, "the opening 42 is closed" means that the communication between the valve chamber 41*a* and the outside of the valve housing 41 via the opening 42 is prevented. The valve body 43 has a disk-shaped valve portion 43*a* disposed in the valve chamber 41*a*, and the valve shaft portion 43*b* extending from the valve portion 43*a* downwardly through the opening 42. The valve shaft portion 43*b* is integral with the valve portion 43*a*. On the upper outer edge of the opening 42, a sealing member or an O-ring 44 is provided. The O-ring 44 liquid-tightly seals the valve chamber 41*a* from the outside of the valve housing 41 by elastically contacting the valve portion 43*a* of the valve body 43.

The first joint valve 40 further includes a coil spring 45 positioned in the valve chamber 41*a*. The coil spring 45 applies an urging force to the valve body 43 such that the opening 42 is closed by the valve body 43. The initial load and a spring constant of the coil spring 45 is set such that the sum of a force F1 applied to the valve body 43 by the pressure inside the valve housing 41 in a direction toward the opening 42 and a force (urging force) F2 applied to the valve body 43 by the coil spring 45 (=F1+F2) is substantially equal to or slightly greater than a force F3 applied to the valve body 43 by the atmospheric pressure in a direction toward the valve chamber 41*a*.

The first joint valve 40 and the sub-tank 5 communicate with each other at an upper portion of the sub-tank 5, whereas the sub-tank 5 and the recording head 3 communicate with each other at a lower portion of the sub-tank 5. In the ink path extending from the first joint valve 40 to the sub-tank 5, there is provided a pressure control valve 47 (see FIG. 9) which prevents the pressure within the ink path from exceeding a predetermined pressure. When the pressure within the ink path becomes equal to or greater than the predetermined pressure, the pressure control valve 47 may be opened and thereby the excess pressure is released into the atmosphere. Here, the "predetermined pressure" refers to such a pressure that would not cause damage to the menisci formed in the ink eject ports (nozzles) of the recording head 3.

Referring to FIG. 9, the joint valve connection mechanism 80 includes a cam 81 which rotates integrally with a first transfer gear 63, and a push rod 82 slidably in contact with a cam surface (profile) 81A formed on the outer circumferential surface of the cam 81 to be displaced vertically according to the shape of the cam surface 81A. The five second joint valves 30 are accommodated in a valve casing 37 (see FIG. 8) and displaced (moved vertically) integrally. Although not specifically illustrated, one axial end of the push rod 82 (the upper end in FIG. 9) is coupled to the valve casing 37.

Accordingly, when the first transfer gear 63 is rotated with the cam 81, the push rod 82 is vertically displaced according to the shape of the cam surface 81A. This in turn causes the five second joint valves 30 to be integrally vertically displaced according to the shape of the cam surface 81A.

In the arrangement described above, the ink jet printer is adapted to use the station supply system for supplying ink from the main tank unit 20 to the sub-tank 5. That is, to supply ink to the sub-tank 5 when only a small amount of ink is left in the sub-tank 5, the main tank unit 20 and the sub-tank 5 are communicated with each other to refill the sub-tank 5 with ink. On the other hand, when there is no need to refill the sub-tank 5 because the remaining amount of ink in the sub-tank 5 is more than a predetermined amount, the main tank unit 20 and the sub-tank 5 are separated from each other.

Next, description will be made for the ink-supply operation which is performed when the carriage 7 is located in the maintenance zone S2, and the remaining amount of ink in the sub-tank 5 is equal to or less than the predetermined amount. A controller (not shown) of the inkjet printer 1 determines whether the remaining amount of the ink in the sub-tank 5 becomes equal to or less than the predetermined amount. The controller counts how many times ink droplet are ejected from the recording head 3 (including ink ejected from the recording head 3 during purging) or count how much amount of ink is ejected from the recording head 3 (including ink ejected from the recording head 3 during purging), and determines that the remaining amount of the ink in the sub-tank 5 becomes equal to or less than the predetermined amount when the counted number or counted amount has reached a predetermined value since the sub-tank 5 was previously refilled with ink.

Figure 11A:
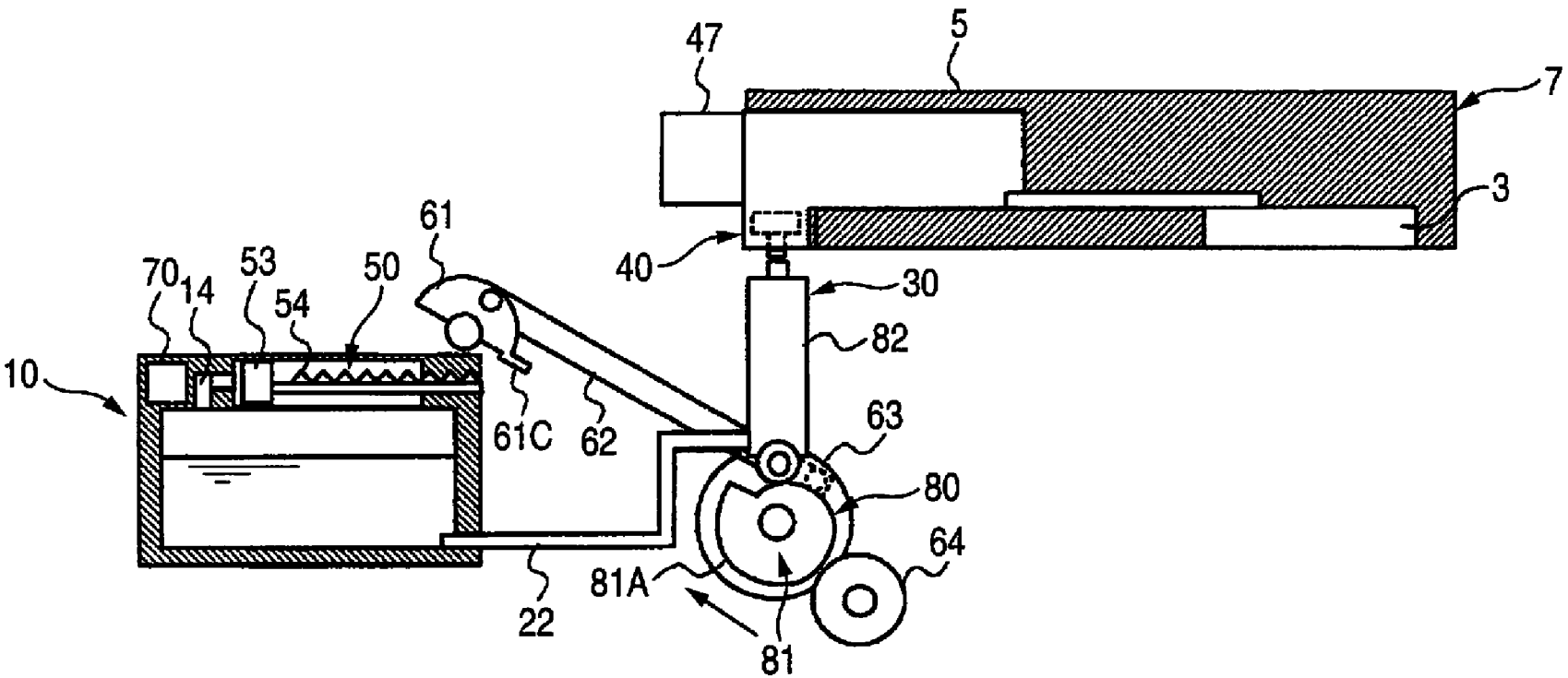
FIGS. 11A to 11F are schematic diagrams illustrating how the main tank unit of FIG. 4 is operated.
Figure 11B:
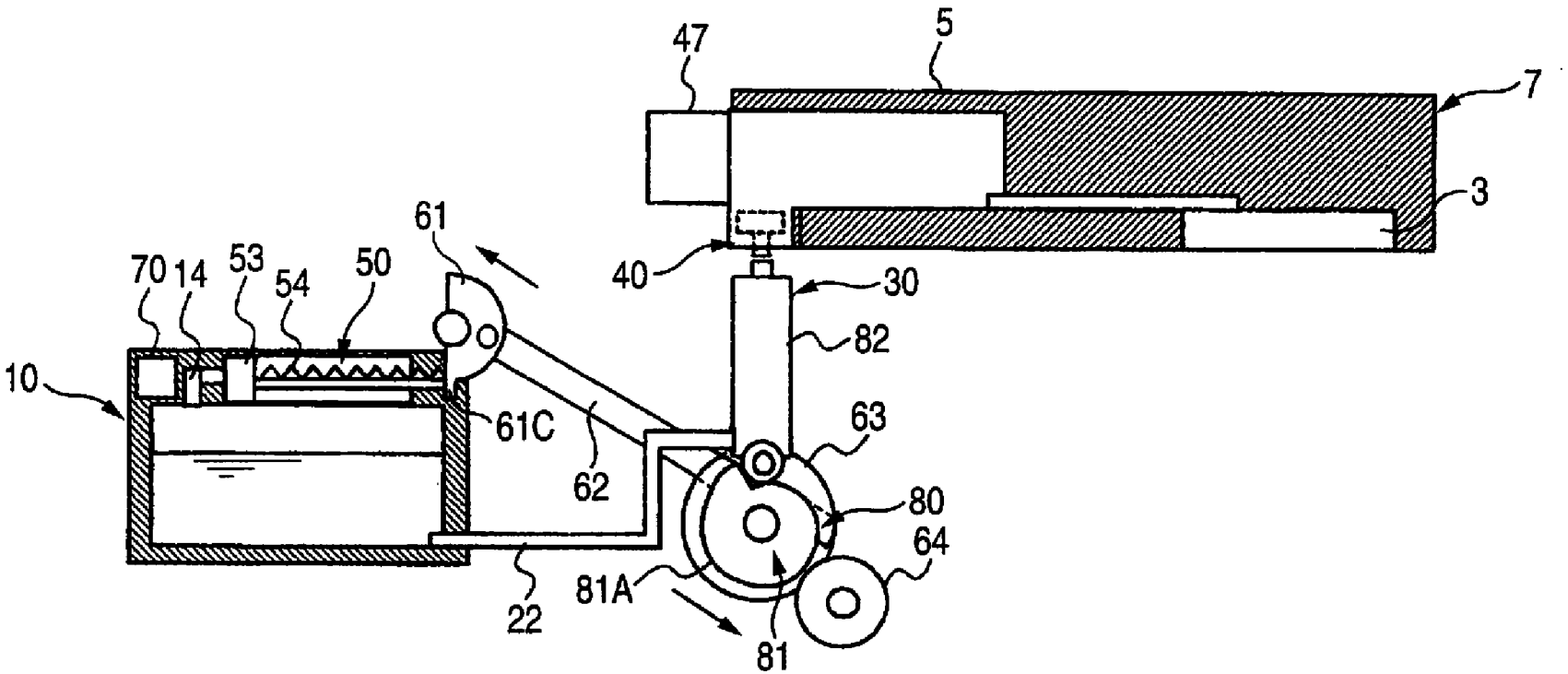
Figure 11C:
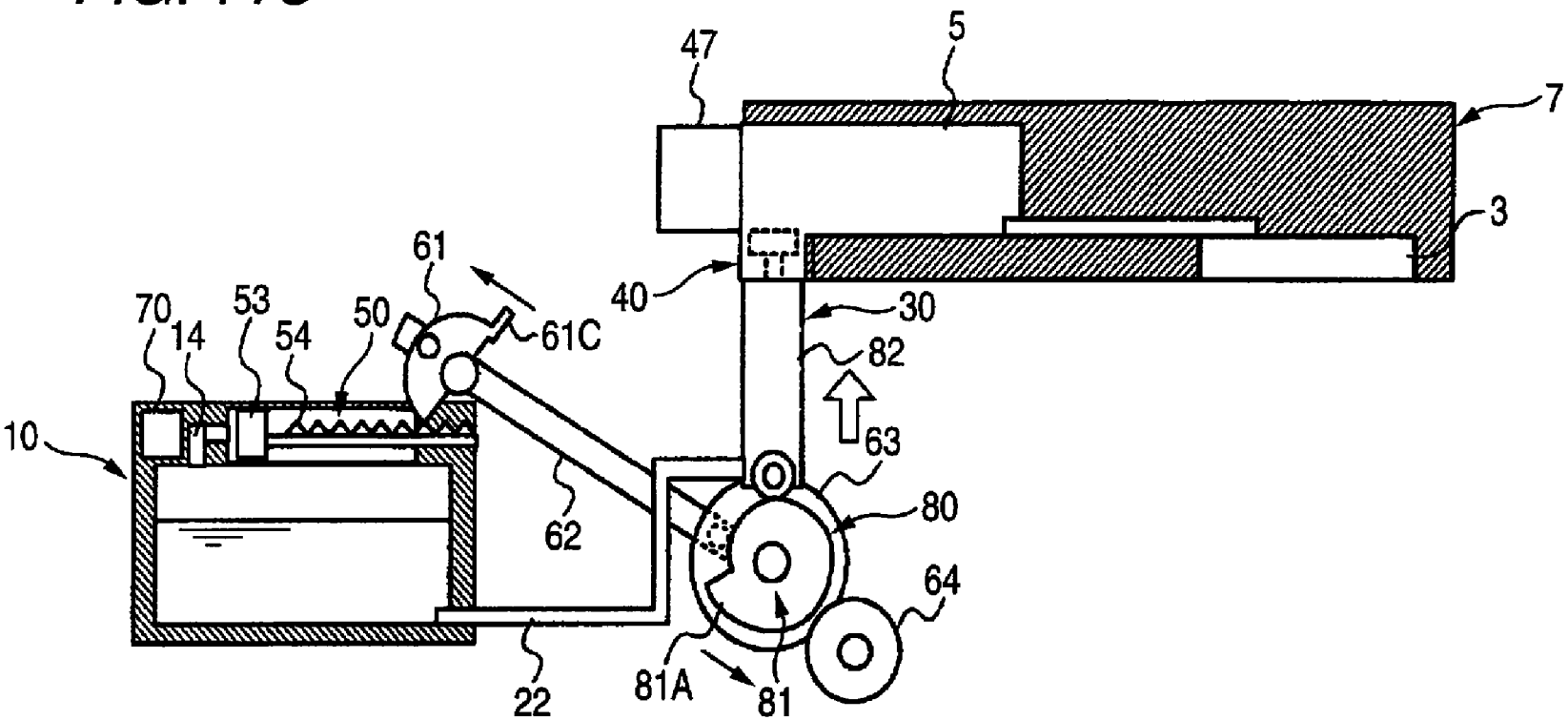

Referring to FIG. 11A, at the moment that the controller determines that the remaining amount of the ink in the sub-tank 5 is equal to or less than the predetermined amount, the joint valves 30 and 40 are separated from each other and closed, and the rack gears 54*a* and the pinions 61 do not engage with each other. Referring to FIG. 11B, before ink is supplied to the sub-tank 5, the initialization process is performed in which the piston pump mechanism 50 is driven to displace the piston 53 to reduce the volume of the pressure chamber 52 in each ink cartridge 10. Specifically, the projected rod contact portion 61C pushes the end of the piston rod 54, and the piston 53 pushes the push rod unit 73 in each ink cartridge 10, such that the atmosphere communication hole 15 is brought into communication with the main tank 11 in each ink cartridge 10. Consequently, the internal pressure of the main tank 11 becomes equal to the atmospheric pressure. Next, referring to FIG. 11C, the joint valve connection mechanism 80 lifts up the second joint valves 30 so that the joint valves 30 and 40 are connected with each other. This causes the sub-tanks 5 and the main tanks 11 of the ink cartridges 10 to communicate with each other.

Figure 12B:
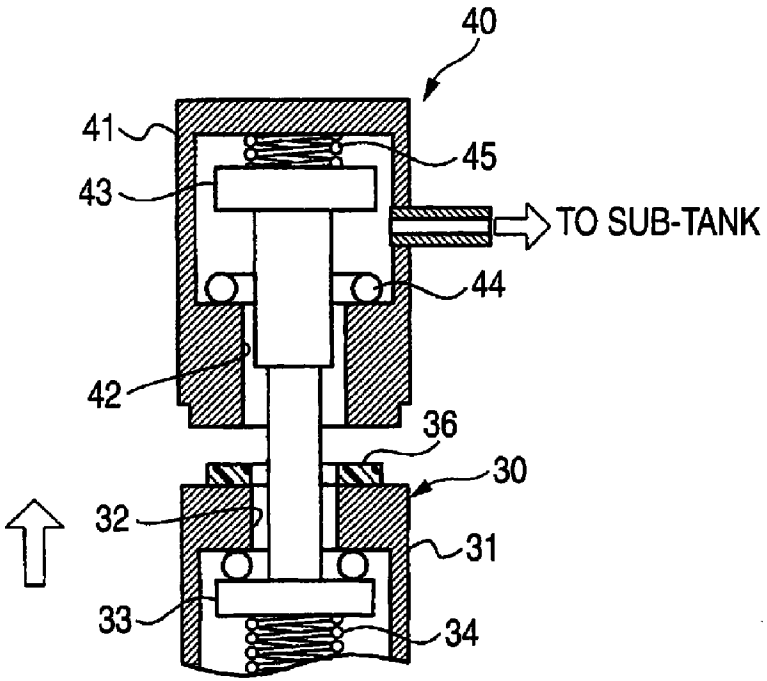
FIGS. 12A to 12D are schematic diagrams illustrating how the joint valves of FIG. 10 are operated.
Figure 12A:
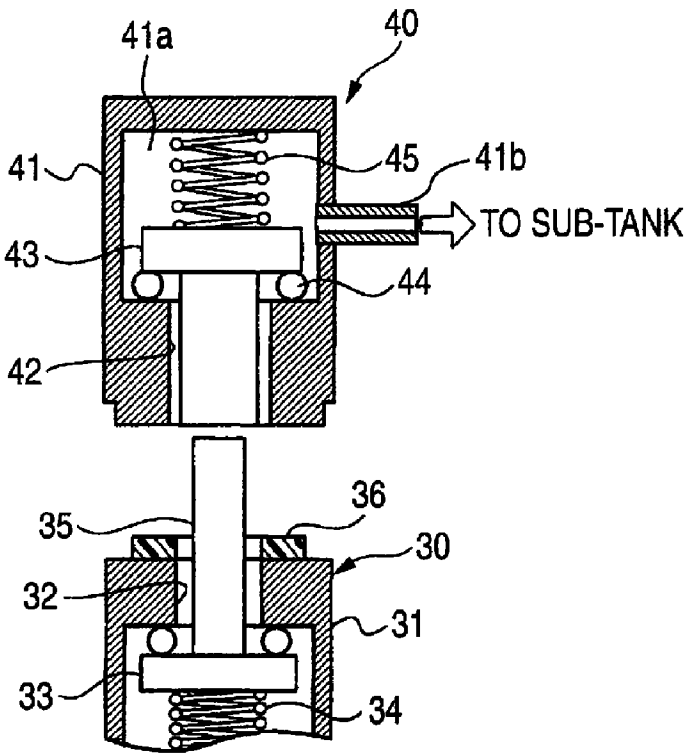
Figure 12D:
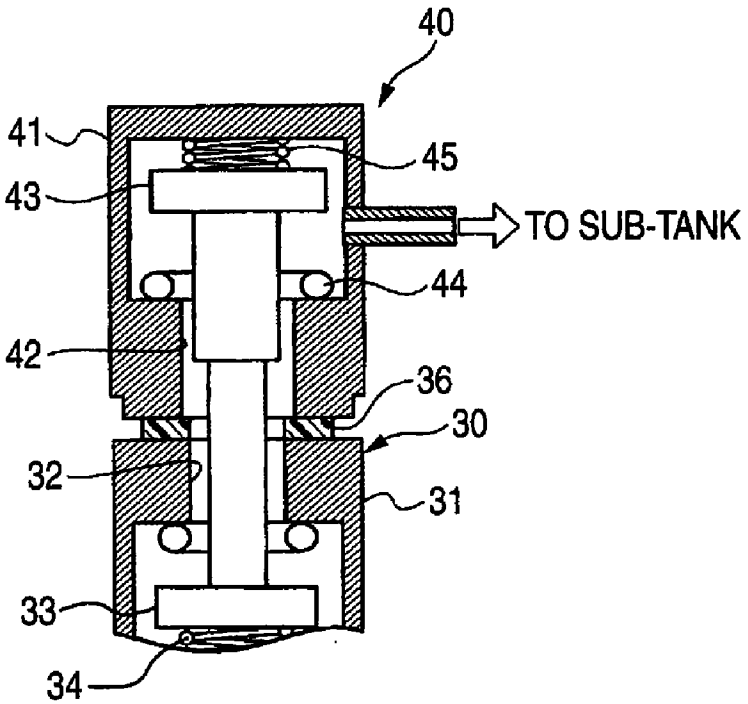
Figure 12C:
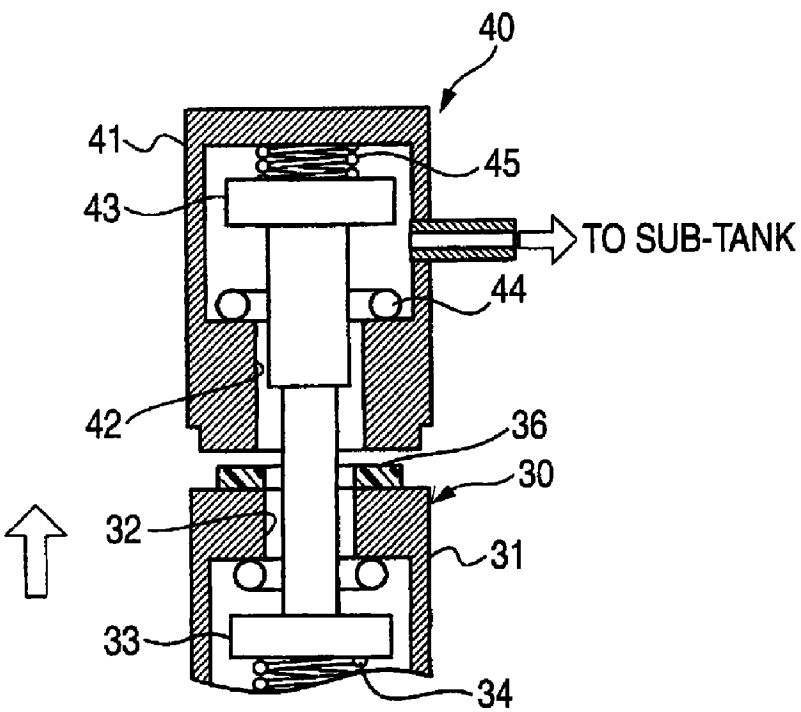

The operation of the joint valves 30 and 40 at this time will be described in more detail with reference to FIGS. 12A to 12D. The joint valves 30 and 40 are initially separated from each other as shown in FIG. 12A. The second joint valves 30 are lifted up to approach the first joint valves 40, and, referring to FIG. 12B, the valve bodies 33 push the valve bodies 43 upwardly to open the openings 42 of the first joint valves 40. After that, the openings 32 of the second joint valves 30 start to open, so that the valve chambers 31*a* and 41*a* of the joint valves 30 and 40 are brought into communication with the atmosphere as shown in FIG. 12C. Then, finally, referring to FIG. 12D, the joint valves 30 and 40 are connected with each other in a liquid-tight manner and communicate with each other so that the ink can be supplied from the main tanks 11 of the ink cartridges 10 to the joint valves 40.

Figure 11D:
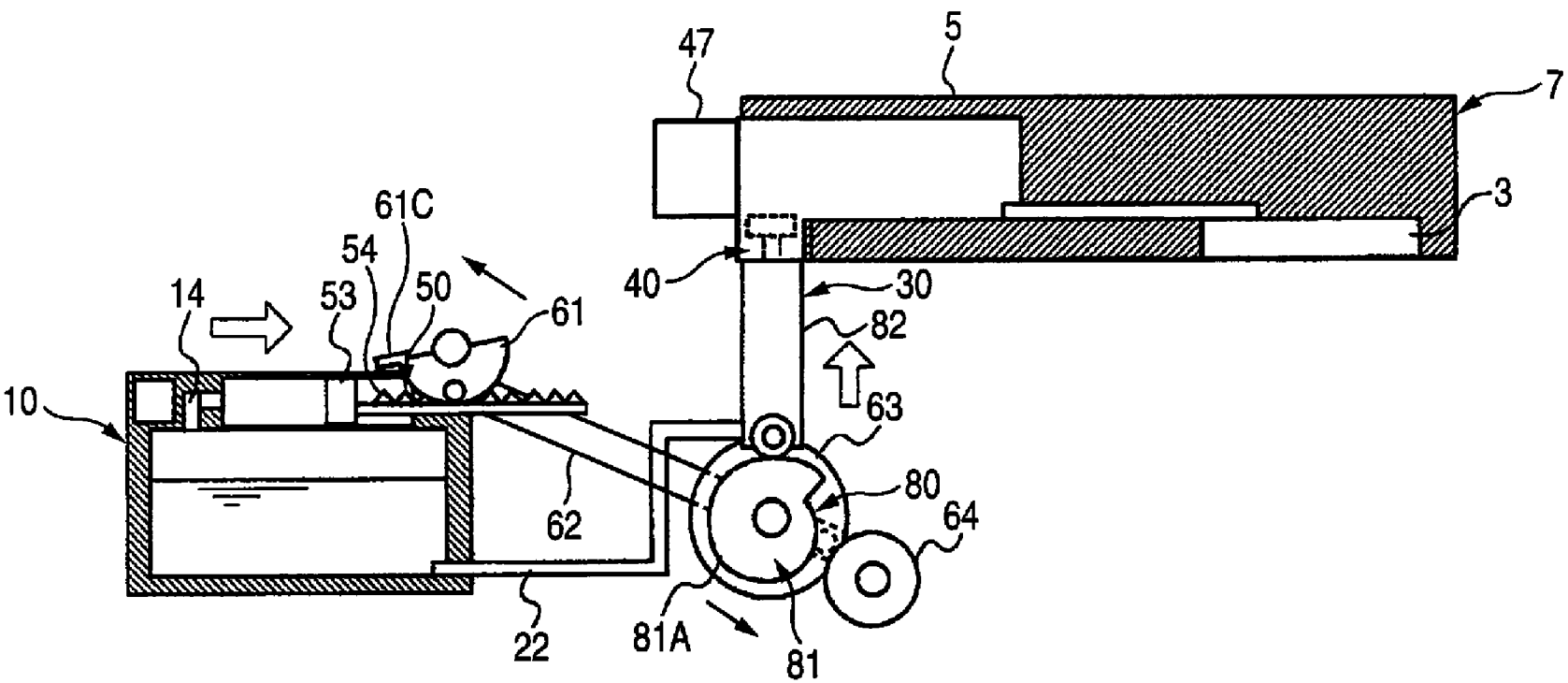

Then, referring to FIG. 11D, the teeth portion 61A engages the rack gear 54A and the piston pump mechanism 50 is actuated to displace the piston 53 in each ink cartridge 10 so that the volume of the pressure chamber 52 increases to draw the ink from the sub-tank 5 into the main tank 11 until each of the sub-tanks 5 becomes almost empty. Almost all the amount of ink in each of the sub-tanks 5 is allowed to flow back to a corresponding one of the main tanks 11 of the ink cartridges 10. When the piston 53 is displaced, the piston rod 54 is supported by the rib 8 contacting the support portion 54B. Therefore, the piston rod 54 makes a smooth, stable linear movement.

Figure 11E:
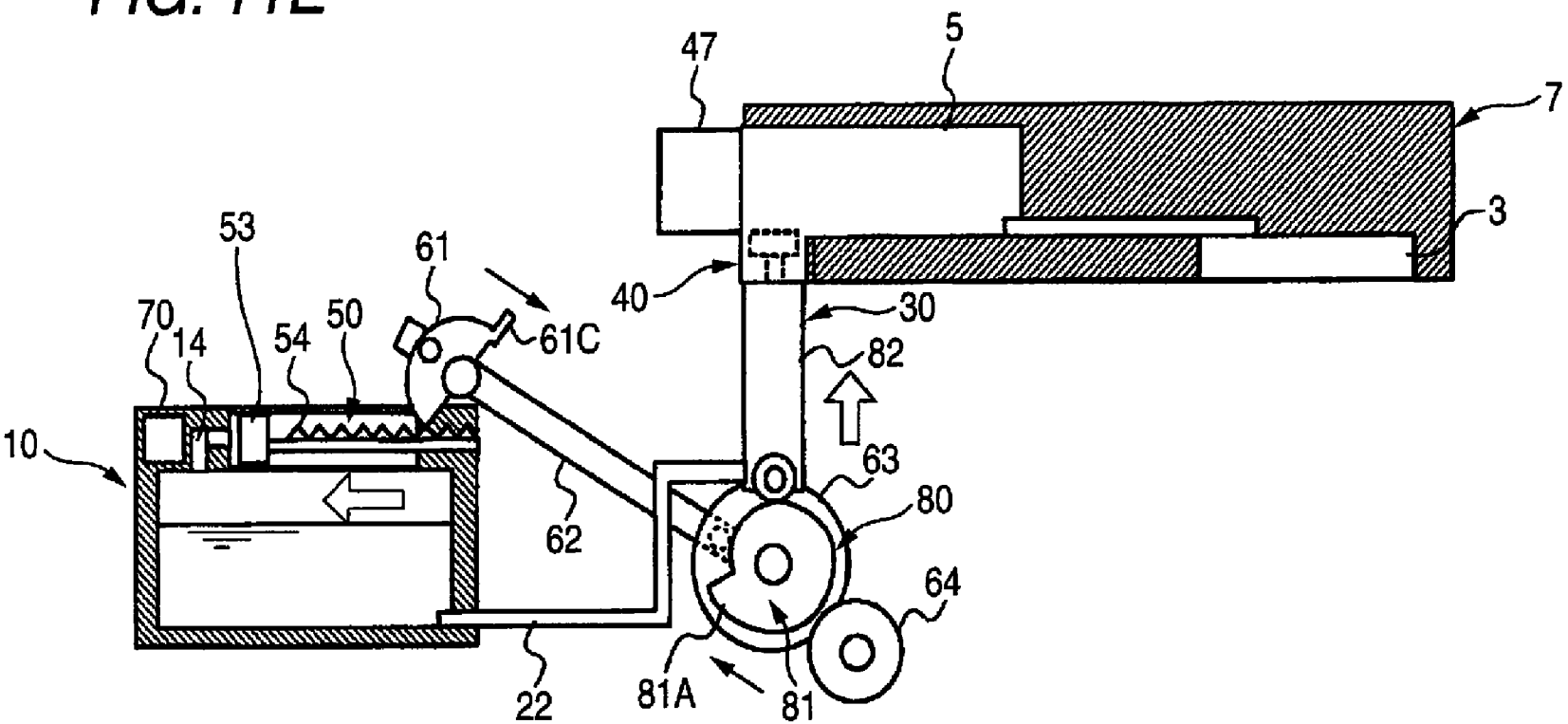
Figure 11F:
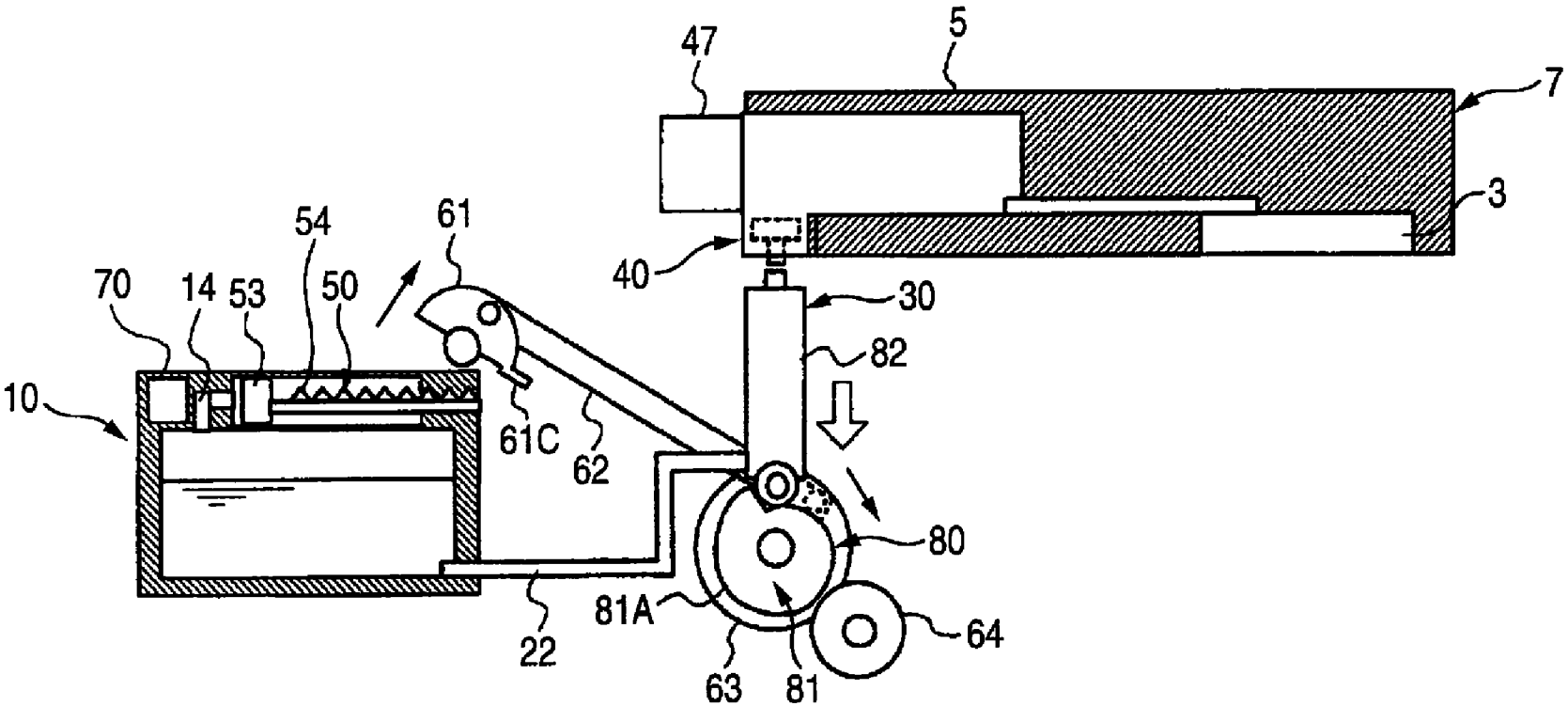

Referring to FIG. 11E, after a certain elapse of time, the piston 53 is displaced to reduce the volume of the pressure chamber 52 to such an extent that the atmosphere release valve 70 is not opened while the joint valves 30 and 40 remains connected with each other. This allows the ink in each of the main tanks 11 of the ink cartridges 10 to be supplied to a corresponding one of the sub-tanks 5. At this time, since the pressure control valve 47 prevents the pressure of the supplied ink from exceeding such a pressure as to damage the menisci of ink in the recording head 3, the ink is supplied to the sub-tanks 5 without damaging the menisci. Referring to FIG. 11F, after a wait of a certain time, while not displacing the pistons 53, the joint valve connection mechanism 80 lowers the second joint valves 30 to separate the second joint valves 30 from the first joint valves 40.

During the recording operation, the first joint valves 40 and the second joint valves 30 are disconnected from each other, so that the first joint valves 40 and the second joint valves 30 are closed. Since consuming the ink in the sub-tanks 5 will decrease the pressure inside the sub-tanks 5, the decreased pressure (negative pressure) inside the sub-tanks 5 serves to maintain the menisci formed in the recording head 3.

The present inventive concept is not limited to the exemplary embodiment explained by means of the above descriptions and by reference to the drawings, and, for instance, modified exemplary embodiments such as those provided below also fall within the technical scope of the present invention.

Figure 13A:
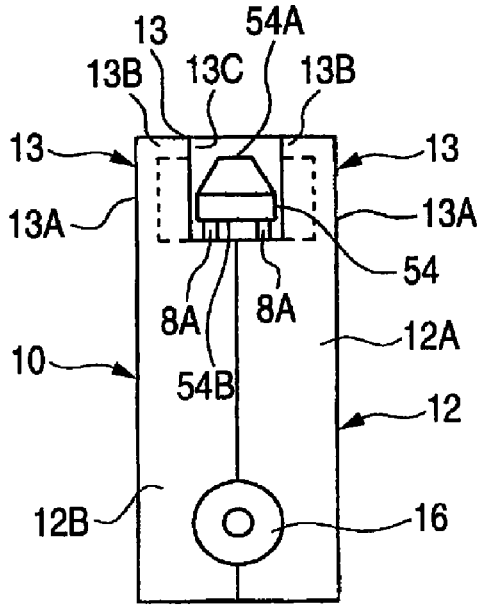
FIGS. 13A and 13B are rear side views of ink cartridges according to modified examples of the present invention, respectively.

(i) According to the exemplary embodiment, the rib 8 having a relatively wider width is employed as the support member; however, referring to FIG. 13A, it is also possible to use a plurality of, e.g., two ribs 8A, each having a relatively narrower width.

Figure 13B:
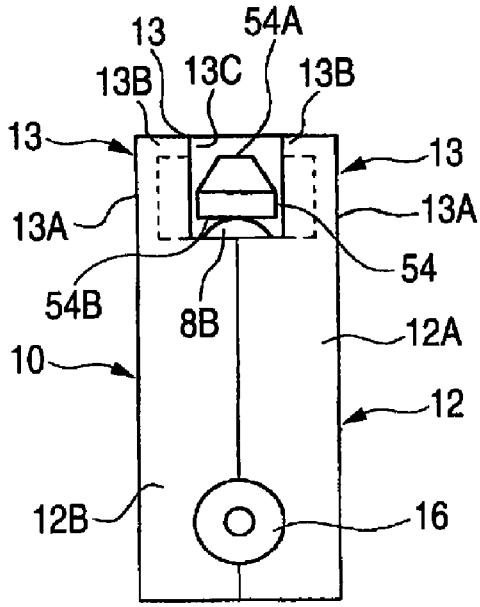

(ii) According to the exemplary embodiment, the rib 8, which is rectangular in cross section, is used as the support member. However, the smaller the contact area between the support member and the support portion 54B, the less the frictional resistance between the support member and the support portion 54B becomes. This allows the piston rod 54 to move more smoothly. Thus, referring to in FIG. 13B, such a rib 8B including a curved convex surface can be used, in which the rib 8B contacts the support portion 54B of the piston rod 54 at the curved convex surface.

(iii) According to the exemplary embodiment, the retaining unit 11A is provided above the main tank 11 to retain the support member 8 for supporting the piston rod 54; however, it is not always necessary to provide the retaining unit 11A above the main tank 11. For example, it is also possible to provide a retaining unit for retaining the support member so as to protrude inwardly from the first and/or second casings 12A and 12B.

(iv) According to the exemplary embodiment, the pinion 61 serving as the drive member has a semicircular shape with the teeth portion 61A and the non-tooth portion 61B; however, the present invention is not limited thereto.

(v) According to the exemplary embodiment, the liquid droplet ejection device is adapted to use the station supply system which is connected with the liquid cartridge only when liquid is supplied from the liquid cartridge to the sub-tank; however, the present invention is not limited thereto. It is also possible to adopt a so-called tube supply system which allows the sub-tank and the liquid cartridge to be communicated with each other even when the liquid is not being supplied to the sub-tank.

(vi) According to the exemplary embodiment, the piston pump mechanism 50 is to supply the liquid to the sub-tank 5; however, the present invention is not limited thereto. The piston pump mechanism 50 may also be used as a unit for providing pressure to ink within the recording head 3 to purge bubbles contained in the ink within the recording head 3. This piston pump mechanism 50 for purging operation may be used in a liquid droplet ejection device using the tube supply system which has no sub-tanks.

(vii) According to the exemplary embodiment, description was made for an ink cartridge serving as a liquid cartridge used in an ink jet printer; however, the present invention is not limited thereto. The inventive concept of the present invention is also applicable to a liquid cartridge used in other liquid droplet ejection devices which apply a liquid colorant in the form of fine liquid droplets or eject electrically conductive liquid to form conductor patterns.

As discussed above, the present invention can provide at least following illustrative, non-limiting embodiments:

A liquid cartridge mountable on a liquid droplet ejection device including an ejection head for ejecting liquid droplets and a sub-tank for temporarily storing a liquid to be supplied to the ejection head. The liquid cartridge includes: a liquid chamber configured to store a liquid therein, and a pump unit configured to generate a pressure for the liquid stored in the liquid chamber to be supplied to the sub-tank. The pump unit including: a cylinder; a piston mounted in the cylinder slidably in a sliding direction and the cylinder and the piston configured to define a pressure chamber communicating with the liquid chamber; a force transfer member coupled to the piston and including an engagement portion and a support portion which is positioned opposite the engagement portion, the engagement portion configured to engage a drive member of the liquid droplet ejection device and to receive a drive force from the drive member to displace the piston; and a support member configured to contact the support portion to support the force transfer member to be movable in the sliding direction.

According to the above configuration, the support member supports the force transfer member by contacting the support portion of the force transfer member. This allows for smooth, linear movement of the force transfer member, which leads to stable movement of the piston.

The engagement portion may include a rack gear, and the drive member may include a pinion configured to engage the rack gear.

According to this configuration, the rack gear and the pinion are engaged with each other. Therefore, the drive force can be stably transferred.

The liquid container may have a front face and a rear face opposite the front face, and the front face and the rear face may be aligned in the sliding direction. When the piston is positioned such that the pressure chamber has a minimum volume, the force transfer member may be entirely positioned between the front face and the rear face in the sliding direction.

According to this configuration, until the piston is positioned such that the pressure chamber has the minimum volume, the support member allows the force transfer member to be smoothly moved, thereby driving the piston stably.

The pump unit and the liquid chamber may be aligned in a vertical direction, and the force transfer member moves in a horizontal direction which is perpendicular to the vertical direction. The engagement portion may be configured to engage the drive member of the liquid droplet ejection device at a position out of the cylinder of the pump unit and above the liquid chamber. The liquid cartridge may further include a retaining unit disposed between the force transfer member and the liquid chamber. The support member may be provided on the retaining unit.

According to this configuration, the engagement portion engages with the drive member of the liquid droplet ejection device at a position above the liquid chamber. Thus, by providing the retaining unit above the liquid chamber to face the force transfer member, the support member can be readily provided on the retaining unit.

The support member may include a single rib or a plurality of ribs.

According to this configuration, the support member includes a single rib or a plurality of ribs, thereby simplifying the structure.

The support member includes a curved convex surface, and the support member contacts the support portion of the force transfer member at the curved convex surface.

According to this configuration, the support member has the curved convex surface for contacting and supporting the force transfer member. Therefore, the contact area between the support member and the support portion of the force transfer member is small, which advantageously reduces the frictional resistance between the support member and the support portion of the force transfer member when the force transfer member moves, thereby allowing the force transfer member to move smoothly.

The liquid cartridge may further include a supply outlet which communicates with the liquid chamber. The liquid cartridge may be mountable on a cartridge accommodating casing including a liquid supply tube, a joint portion positioned at one end of the liquid supply tube, a joint valve positioned at the other end of the liquid supply tube, and the drive member configured to provide the drive force to the force transfer member to displace the piston. The supply outlet may be configured to be connected to the joint portion of the cartridge accommodating casing when the liquid cartridge is mounted on the cartridge accommodating casing. The joint valve of the cartridge accommodating casing may be connectable to a joint valve of the sub-tank. When the joint valves are connected with each other, the liquid chamber communicates with the sub-tank via the liquid supply tube and the joint valves.

According to this configuration, the connection between the joint valves of the cartridge accommodating casing and the joint valve of the sub-tank allows the main tank to communicate with the sub-tank via the liquid supply tube and the joint valves.

The ejection head and the sub-tank may be positioned in a carriage configured to reciprocate within a predetermined range in a main-scanning direction. The cartridge accommodating casing may be disposed at one end portion of the predetermined range in the main-scanning direction.

According to this configuration, it is possible to position the cartridge accommodating casing without adversely affecting the operation of the liquid droplet ejection device.

A liquid cartridge includes: a liquid chamber configured to store a liquid, the liquid chamber including an liquid outlet; a cylinder; a piston mounted in the cylinder slidably in a sliding direction, and the cylinder and the piston configured to define a pressure chamber communicating with the liquid chamber; a force transfer member coupled to the piston and including an engagement portion and a support portion which is positioned opposite the engagement portion, the engagement portion configured to engage a drive member and to receive a drive force from the drive member to displace the piston; and a support member configured to contact the support portion to support the force transfer member to be movable in the sliding direction.

According to the above configuration, the support member supports the force transfer member by contacting the support portion of the force transfer member. This allows for smooth, linear movement of the force transfer member, which leads to stable movement of the piston.

What is claimed is:

1. A liquid cartridge mountable on a liquid droplet ejection device including an ejection head for ejecting liquid droplets and a sub-tank for temporarily storing a liquid to be supplied to the ejection head, the liquid cartridge comprising:

a liquid chamber configured to store a liquid therein, and a pump unit configured to generate a pressure for the liquid stored in the liquid chamber to be supplied to the sub-tank, the pump unit including:

a cylinder;

a piston mounted in the cylinder slidably in a sliding direction, the cylinder and the piston configured to define a pressure chamber communicating with the liquid chamber;

a force transfer member coupled to the piston and including an engagement portion and a support portion which is positioned opposite the engagement portion, the engagement portion configured to engage a drive member of the liquid droplet ejection device and to receive a drive force from the drive member to displace the piston; and a support member configured to contact the support portion to support the force transfer member to be movable in the sliding direction.

2. The liquid cartridge according to claim 1, wherein the engagement portion includes a rack gear, and wherein the drive member includes a pinion configured to engage the rack gear.

3. The liquid cartridge according to claim 1, wherein, the liquid container has a front face and a rear face opposite the front face, and the front face and the rear face is aligned in the sliding direction, and when the piston is positioned such that the pressure chamber has a minimum volume, the force transfer member is entirely positioned between the front face and the rear face in the sliding direction.

4. The liquid cartridge according to claim 1, wherein:

the pump unit and the liquid chamber are aligned in a vertical direction, and the force transfer member moves in a horizontal direction which is perpendicular to the vertical direction;

the engagement portion is configured to engage the drive member of the liquid droplet ejection device at a position out of the cylinder of the pump unit and above the liquid chamber;

the liquid cartridge further comprises a retaining unit disposed between the force transfer member and the liquid chamber; and the support member is provided on the retaining unit.

5. The liquid cartridge according to claim 1, wherein the support member includes a plurality of ribs.

6. The liquid cartridge according to claim 1, wherein the support member is a single rib.

7. The liquid cartridge according to claim 1, wherein the support member includes a curved convex surface, and the support member contacts the support portion of the force transfer member at the curved convex surface.

8. The liquid cartridge according to claim 1, wherein the liquid chamber comprises a supply outlet, wherein the liquid cartridge is mountable on a cartridge accommodating casing including a liquid supply tube, a joint portion positioned at one end of the liquid supply tube, a joint valve positioned at the other end of the liquid supply tube, and the drive member configured to provide the drive force to the force transfer member to displace the piston, wherein the supply outlet is configured to be connected to the joint portion of the cartridge accommodating casing when the liquid cartridge is mounted on the cartridge accommodating casing, wherein the joint valve of the cartridge accommodating casing is connectable to a joint valve of the sub-tank, and wherein when the joint valves are connected with each other, the liquid chamber communicates with the sub-tank via the supply outlet, the liquid supply tube, and the joint valves.

9. The liquid cartridge according to claim 8, wherein the ejection head and the sub-tank are mounted in a carriage configured to reciprocate within a predetermined range in a main-scanning direction, and wherein the cartridge accommodating casing is disposed at one end of the predetermined range in the main-scanning direction.

10. A liquid cartridge comprising:

a liquid chamber configured to store a liquid, the liquid chamber including an supply outlet;

a cylinder;

a piston mounted in the cylinder slidably in a sliding direction, the cylinder and the piston configured to define a pressure chamber communicating with the liquid chamber;

a force transfer member coupled to the piston and including an engagement portion and a support portion which is positioned opposite the engagement portion, the engagement portion configured to engage a drive member and to receive a drive force from the drive member to displace the piston; and a support member configured to contact the support portion to support the force transfer member to be movable in the sliding direction.

11. The liquid cartridge according to claim 10, wherein the engagement portion includes a rack gear.

12. The liquid cartridge according to claim 10, wherein the liquid container has a front face and a rear face opposite the front face, and the front face and the rear face is aligned in the sliding direction, and when the piston is positioned such that the pressure chamber has a minimum volume, the force transfer member is entirely positioned between the front face and the rear face in the sliding direction.

13. The liquid cartridge according to claim 10, wherein:

the pump unit and the liquid chamber are aligned in a vertical direction, and the force transfer member moves in a horizontal direction which is perpendicular to the vertical direction;

the engagement portion is configured to engage the drive member at a position out of the cylinder of the pump unit and above the liquid chamber;

the liquid cartridge further comprises a retaining unit disposed between the force transfer member and the liquid chamber; and the support member is provided on the retaining unit.

14. The liquid cartridge according to claim 10, wherein the support member includes a plurality of ribs.

15. The liquid cartridge according to claim 10, wherein the support member is a single rib.

16. The liquid cartridge according to claim 10, wherein the support member includes a curved convex surface, and the support member contacts the support portion of the force transfer member at the curved convex surface.

* * * * *